US009211049B2

(12) United States Patent
Lee et al.

(10) Patent No.: US 9,211,049 B2
(45) Date of Patent: Dec. 15, 2015

(54) DISHWASHER

(75) Inventors: Jongmin Lee, Geumchun-ku (KR); Taehee Lee, Geumchun-ku (KR); Haewoong Lee, Geumchun-ku (KR); Youmin Lee, Geumchun-ku (KR); Seongho Kim, Geumchun-ku (KR); Jungyoup Han, Geumchun-ku (KR)

(73) Assignee: LG ELECTRONICS INC., Seoul (KR)

( * ) Notice: Subject to any disclaimer, the term of this patent is extended or adjusted under 35 U.S.C. 154(b) by 629 days.

(21) Appl. No.: 13/444,048

(22) Filed: Apr. 11, 2012

(65) Prior Publication Data

US 2012/0279527 A1 Nov. 8, 2012

(30) Foreign Application Priority Data

| | | |
|---|---|---|
| Apr. 12, 2011 | (KR) | 10-2011-0033779 |
| Dec. 19, 2011 | (KR) | 10-2011-0137514 |
| Dec. 19, 2011 | (KR) | 10-2011-0137517 |
| Dec. 19, 2011 | (KR) | 10-2011-0137519 |

(51) Int. Cl.

| | |
|---|---|
| ***B08B 3/00*** | (2006.01) |
| ***A47L 15/42*** | (2006.01) |
| ***A47L 15/00*** | (2006.01) |

(52) U.S. Cl.

CPC ..... *A47L 15/4246* (2013.01); *A47L 15/0036*
(Continued)

(58) Field of Classification Search

CPC ..... A47L 15/4234; A47L 2601/04; A47L 15/0015; A47L 15/0002; A47L 2501/06

USPC ..... 134/18, 25.2, 56 D, 105, 57 D, 10, 58 D, 134/106, 107, 110, 108, 172, 176; 210/184, 210/360.1, 416.1, 433.1

See application file for complete search history.

(56) References Cited

U.S. PATENT DOCUMENTS 4,279,384 A * 7/1981 Yamamoto ..... 239/67
7,137,405 B2 * 11/2006 Barrows et al. ..... 137/527.4

(Continued)

FOREIGN PATENT DOCUMENTS

| | | |
|---|---|---|
| EP | 1 738 677 | 1/2007 |
| EP | 1 800 589 | 6/2007 |
| EP | 1 872 703 | 1/2008 |

OTHER PUBLICATIONS

European Search Report dated Jul. 2, 2012.
European Search Report dated Dec. 3, 2014, issued in Application No. 14182428.4.

*Primary Examiner* — Michael Barr
*Assistant Examiner* — Thomas Bucci
(74) *Attorney, Agent, or Firm* — Ked & Associates LLP

(57) ABSTRACT

Provided is a dishwasher. The dishwasher includes a tub having a receiving space in which objects to be washed are received, a sump for storing wash water supplied into the tub, a heater that heats the wash water in the sump to generate steam, a steam nozzle for spraying the steam into the tub, a filter assembly that purifies the wash water supplied to the sump and communicates with the tub so that the steam generated in the sump is supplied into the tub and a barrier for dividing inner space of the sump into a first section communicating with the filter assembly and a second section communicating with the steam nozzle. The barrier allows the wash water flows between the first and second sections and suppresses flow of the steam from the second section to the first section.

20 Claims, 16 Drawing Sheets

(52) U.S. Cl.
CPC . 15/4208 (2013.01); *A47L 15/4221* (2013.01); (2013.01); *A47L 15/0057* (2013.01); *A47L A47L 15/4225* (2013.01); *A47L 15/4234* (2013.01); *A47L 15/0031* (2013.01); *A47L 15/4293* (2013.01); *A47L 2301/04* (2013.01); *A47L 2401/20* (2013.01); *A47L 2501/01* (2013.01); *A47L 2501/02* (2013.01); *A47L 2501/06* (2013.01); *A47L 2501/34* (2013.01)

(56) References Cited

U.S. PATENT DOCUMENTS

| | | | | |
|---|---|---|---|---|
| 7,763,118 | B2 * | 7/2010 | Pyo et al. | 134/56 D |
| 2004/0187898 | A1 | 9/2004 | Chen | 134/58 D |
| 2009/0235957 | A1 * | 9/2009 | Kim | 134/25.2 |
| 2010/0154842 | A1 | 6/2010 | Burgess et al. | |
| 2014/0041688 | A1 * | 2/2014 | Maennle et al. | 134/18 |

* cited by examiner

FIG. 16

| CYCLE | Wash | | Rinse | | | Dry | Water Usage | Cycle Time |
|---|---|---|---|---|---|---|---|---|
| | Pre-Wash | Main Wash | Rinse 1 | Rinse 2 | Heated Rinse | | | |
| Power Scrub | | 131°-145°F 55°-63°C | | | 154°F 68°C | | 5.5-9.2 gal. 21-35 L | 121-176 min. |
| Normal | | 95°-140°F 35°-60°C | | | 149°F 65°C | | 2.6-6.9 gal. 10-26 L | 97-124 min. |
| Quick | | 115°F 46°C | | | 140°F 60°C | | 5.5 gal. 21 L | 78 min. |
| Rinse Only | | | | | | | 1.3 gal. 5 L | 15 min. |

FIG. 17

| MICROORGANISM /PATHOGENIC BACTERIA | STERILIZATION CONDITIONS BY HEATING | |
|---|---|---|
| | °C | min |
| Shigella dysenteriae | 60 | 5 |
| Salmonella typhi | 60 | 5~15 |
| S.paratyphi | 60 | 10 |
| Vibrio cholerae | 56 | 15 |
| Brucella abortus | 60 | 10 |
| Mycobacterium tuberculosis | 60 | 20~30 |
| Streptococcus pyogenes | 60 | 0.4~2.5 |
| Corynebacterium diphtheriae | 58 | 10 |
| Staphylococcus enteritidis | 60 | 15 |
| Vibrio parahaemolyticus | 60 | 15 |
| Pseudomonas aeruginosa | 50 | 60 |
| Streptococcus faecalis | 60 | 30~60 |
| Escherichia coli O157:H7 | 75 | 1 |
| Yeast | 50~60 | 1 |
| Bacillus anthrasis | 100 | 2~15 |

DISHWASHER

This application claims priority to Korean Patent application no. 10-2011-0033779 filed Apr. 12, 2011, Korean Patent application no. 10-2011-0137514 filed Dec. 19, 2011, Korean Patent application no. 10-2011-0137517 filed Dec. 19, 2011, and Korean Patent application no. 10-2011-0137519 filed Dec. 19, 2011, which is hereby incorporated by reference.

BACKGROUND

1. Field

The present invention relates to a dishwasher.

2. Background

In general, a dishwasher is a machine for removing dirt remaining on objects, which are received in a washing chamber thereof and to be washed, using wash water. However, when it is to wash the objects such as dishes, it is difficult to remove the dirt such as smudged garbage adhered to dishes by simply using only the wash water. To remove such as the smudged garbage, dishwashers that can supply moisture, mist, steam, and the like has been recently developed. Theses dishwashers have an advantage in that the smudged garbage adhered to the dishes can be soaked in water by supplying high temperature steam and thus easily removed. However, such dishwashers have a drawback in that an additional device for supplying the steam is required. The additional device for supplying the steam causes reduction of a dish receiving space of the dishwasher and thus an amount of the dishes that can be received in the dish receiving space is reduced. This cannot satisfy users who wish to wash a large amount of dishes at a time. In addition, this makes an internal structure of the dishwasher complicated and maintenance not easy.

BRIEF DESCRIPTION OF THE DRAWINGS

Embodiments will be described in detail with reference to the following drawings in which like reference numerals refer to like elements, and wherein:

FIG. 16 is a table illustrating a variety of courses supplied by the dishwasher of FIG. 9; and FIG. 17 is a table illustrating sterilization conditions by heating depending on types of microorganisms and types of pathogenic bacteria.

DETAILED DESCRIPTION

Hereinafter, exemplary embodiments of the present invention will be described in more detail with reference to the accompanying drawings. A dishwasher referred to herein means a machine that can dry, wash, and sterilize objects to be washed such as dishes. However, for descriptive convenience, the description will be done on the basis of a dishwasher for the purpose of drying and washing the objects. In addition, the dishwasher referred to herein will be described as a machine including a dish washing machine and a dish drying machine, which can wash, dry, and sterilize tableware (hereinafter, referred to as "objects to be washed").

Figure 1:
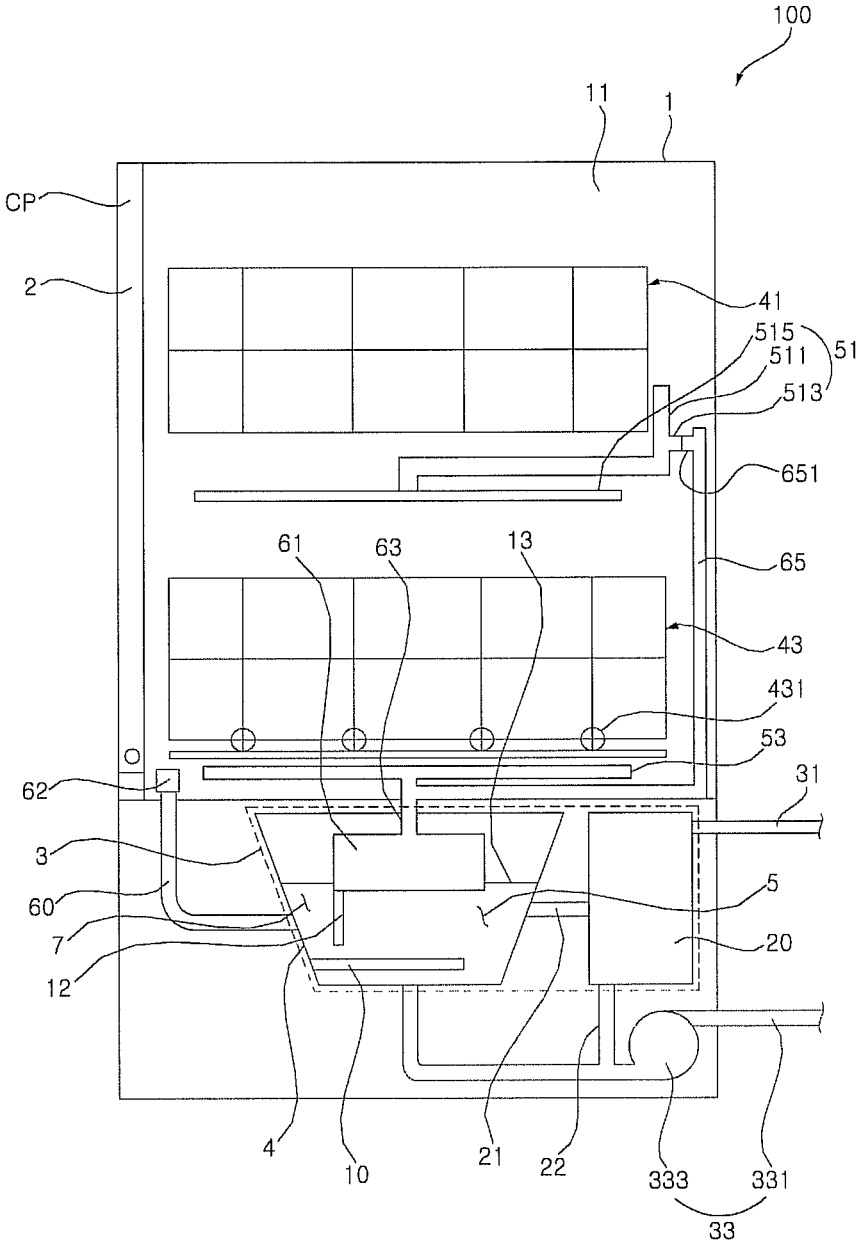
FIG. 1 is a side sectional view of a dishwasher according to an exemplary embodiment of the present invention.
Figure 2:
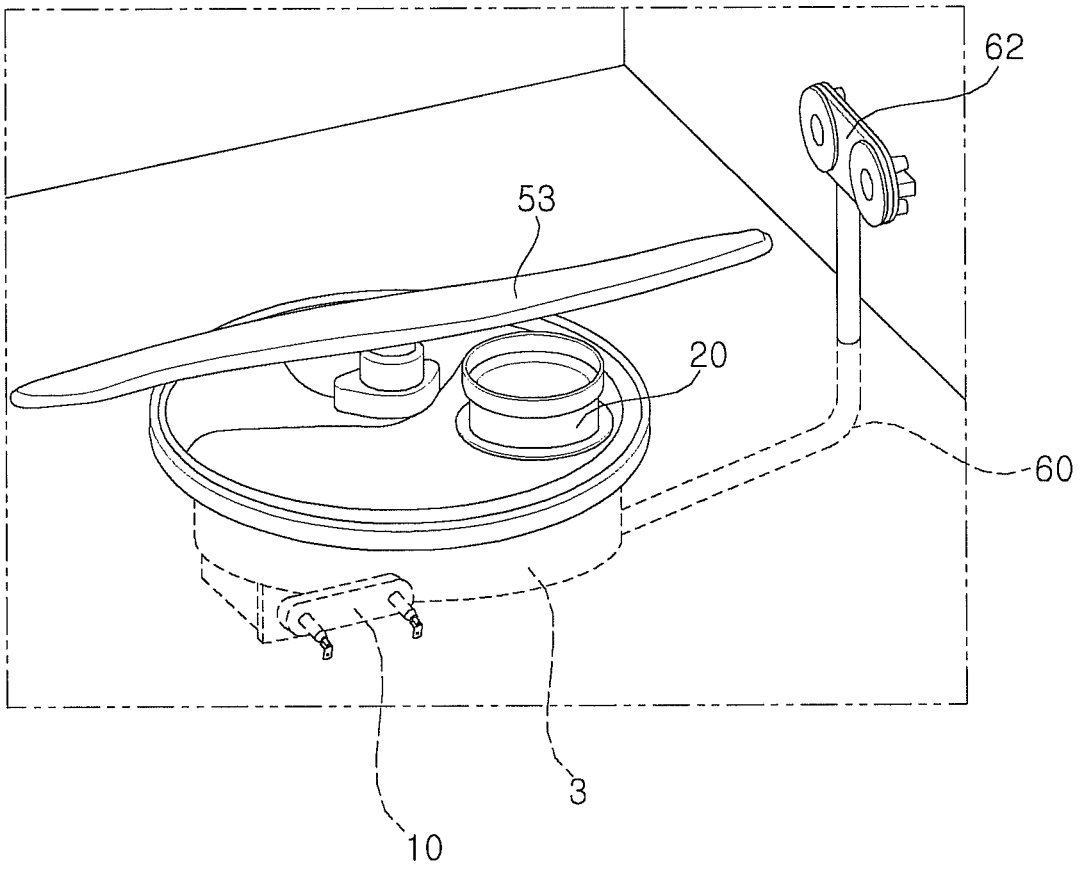
FIG. 2 is a perspective view of an inner side of a tub depicted in FIG. 1.

FIG. 1 is a side sectional view of a dishwasher according to an exemplary embodiment of the present invention, and FIG. 2 is a perspective view of an inner-lower side of a tub depicted in FIG. 1.

Referring to FIGS. 1 and 2, a dishwasher 100 includes a tub 1 providing a treating chamber 11, a door 2 for selectively opening and closing a side of the treating chamber 11, and a control panel CP that is provided on a tub 1 to control operation of the dishwasher 100.

The treating chamber 11 is defined in the tub 1 and has an opened side. The door 2 may be provided on the tub 1 so that a user can selectively open and close the opened side of the treating chamber 11.

A sump 3 for storing wash water, a rack for receiving objects to be washed such as tableware, and a spray arm for spraying wash water to the objects received in the rack may be provided in the treating chamber 11.

The sump 3 stores the wash water required for washing the objects. In more detail, the sump is connected to a water source by a water supply unit 31. The wash water stored in the sump 3 is drained out of the dishwater 100 through a drain unit 33. The water supply unit 31 may include a water supply hose connected between the sump 3 and the water source. The drain unit 33 may include a drain pump 333 and a drain hose 331 for draining the wash water out of the sump 3. The structure of the sump 3 will be described later in more detail.

Meanwhile, the rack is structured to receive the objects to be washed such as the dishes. The dishes received in the rack are washed by the wash water sprayed from the spray arm. The rack may be variously structured depending on a volume, purpose, and the like of the dishwasher 100. That is, one or more racks may be provided. For example, the dishwasher 100 may include an upper rack 41 provided at an upper side of the treating chamber 11 and a lower rack 43 disposed under the upper rack 41. The upper and lower racks 41 and 43 may be structured to be come in and out of the treating chamber 11 through the opened side of the tub 1.

The spray arm is designed to spray the wash water toward the dishes received in the rack(s). To this end, the spray arm is structured to correspond to the rack(s). However, the number of the spray arms may be greater than the number of the racks or the number of the racks may be greater than the number of the spray arms. For example, in this exemplary embodiment, the spray arms may include an upper arm 51 for spraying the wash water toward the upper rack 41 and a lower arm 53 for spraying the wash water toward the lower rack 43.

The lower arm 53 is connected to a lower supply passage 63 and is designed to be capable of rotating under the lower rack 43. The upper arm 51 is connected to an upper supply passage 65 and is designed to be capable of rotating under the upper rack 41.

The upper arm 51 may include an upper spray nozzle 515 for spraying the wash water toward the upper rack 41 and a supply passage 511 for supplying the wash water to the upper spray nozzle 515. The upper arm 51 may be detachably mounted on a lower portion of the upper rack 41. At this point, the supply passage 511 may be further provided with a passage mounting/dismounting portion 513 communicating with an arm mounting/dismounting portion 651 of an upper supply passage 65, which will be described later.

Meanwhile, the upper and lower spray arms 51 and 53 may be designed to spray the wash water, which is directed supplied from the water source provided at an external side of the dishwasher, toward the objects to be washed. Alternatively, as shown in FIG. 1, the upper and lower spray arms 51 and 53 may be designed to spray the wash water stored in the sump 3.

When the upper and lower spray arms 51 and 53 are designed to spray the wash water stored in the sump 3, the dishwasher may include a supply pump 61 for pumping out the wash water stored in the sump 3, a lower supply passage 63 for supplying the wash water from the supply pump 61 to the lower arm 53, and an upper supply passage 65 for supplying the wash water to the upper arm 51.

The upper supply passage 65 includes the arm mounting/dismounting portion 651 connected to the passage mounting/dismounting portion 513 of the upper arm 51. This is for, when the upper arm 51 is detachably mounted on the upper rack 41, supplying the wash water. That is, when the user draws the upper rack 41 out of the treating chamber 11, the upper arm 51 is separated from the supply passage 65 along the upper rack 41. However, when the user draws the upper rack 41 into the treating chamber 11, the supper arm 51 is connected to the supply passage 65.

Meanwhile, when washing the objects such as the dishes, it is sometimes difficult to remove the dirt such as smudged garbage adhered to dishes by simply using only the wash water. To remove such as the smudged garbage, dishwashers that can supply moisture, mist, steam, and the like has been recently developed. Theses dishwashers have an advantage in that the smudged garbage adhered to the dishes can be soaked in water by supplying high temperature steam and thus easily removed. However, such dishwashers have a drawback in that an additional device for supplying the steam is required. The additional device for supplying the steam causes reduction of a dish receiving space of the dishwasher and thus an amount of the dishes that can be received in the dish receiving space is reduced. This cannot satisfy users who wish to wash a large amount of dishes at a time. In addition, this makes an internal structure of the dishwasher complicated and maintenance not easy. The following will describe a dishwasher that is simplified in a structure while providing high temperature moisture such as steam.

The dishwasher 100 according to the exemplary embodiment of the present invention may include a heater 10 for heating the wash water in the sump 3. That is, the wash water is heated by the heater 10. This heated wash water is supplied through the above-described spray arm(s). In addition, according to the exemplary embodiment of the present invention, the heater 10 heats the wash water stored in the sump 3 to generate the steam. That is, in this exemplary embodiment, no steam generator is specially provided. Instead, the heater 10 is provided in the sump 3 and the wash water that is heated by adjusting a heating temperature and a heating time is supplied. Alternatively, the wash water is heated to generate the steam and the steam is supplied. Accordingly, the dishwasher of this exemplary embodiment is designed to simplify the structure for supplying the steam. Therefore, the treating chamber 11 in the tub 1 can be maximized and thus the dishwasher having the large capacity can be realized. In addition, by simplifying the internal structure of the dishwasher, the dishwasher has the advantage of performing the maintenance. Hereinafter, the dishwasher having this structure will be described in more detail with reference to the accompanying drawings.

The sump 3 stores the wash water to be supplied into the tub 1 and the heater 10 for heating the wash water is provided in the sump 3. That is, the wash water is heated by operating the heater 10 and the heated wash water is supplied into the treating chamber through the spray arms 51 and 53. Alternatively, the steam is generated by the heater 10 and the steam is supplied into the treating chamber 11 through at least one passage which communicates the sump 3 and the treating chamber 11. Accordingly, the dishwasher 100 includes a sump housing 4 provided in the sump 3 to receive the wash water and the heater 10 is provided in the sump housing 4. At this point, the heater 10 may be buried in the sump housing 4.

Meanwhile, the sump 3 may further include a filter assembly 20 for purifying the wash water supplied from the water supply unit 31. The filter assembly 20 removes foreign substances from the wash water supplied from the water supply unit 31 and supplies the wash water from which the foreign substances are removed to the sump housing 4 through a connecting portion 21. In addition, the filter assembly 20 may be designed to at least partly communicate with the treating chamber. For example, as shown in FIG. 2, an upper portion of the filter assembly 20 may communicate with the treating chamber 11 of the tub 1 so that the wash water supplied through the water supply unit 31 can be purified and, at the same time, the wash water that is supplied into the treating chamber 11 of the tub 1 through the spray arms 51, 53 and falling can be directly directed toward the filter assembly 20. That is, at least a portion of the wash water that is supplied through the spray arms 51, 53, used to wash the dishes, and falling is immediately purified through the filter assembly 20, after which the purified wash water is redirected to the sump 2. The purified wash water redirected to the sump 3 is supplied to the spray arm 51, 53 through the lower and upper supply passages 63 and 65 by the operation of the pump 61 in a state where it is heated by the heater 10 or not heated. The pump 61 is provided on a horizontal harrier 13 provided in the sump housing 4 so that it can pump out the wash water. The wash water supply structure through the atm is already described above and thus the description thereof will be omitted herein. The sump housing 4 has an opening through which the wash water in the sump housing 4 is supplied into the pump 61.

The steam generated by the heater 10 is supplied into the tub 1 through an additional passage. That is, the dishwasher 100 may include a steam supply passage 60 connected to the sump housing 4 and a steam nozzle 62 for spraying the steam into the treating chamber 11 of the tub 1. Accordingly, the steam generated in the sump housing 4 by the heater 10 is supplied into the tub 1 through the steam supply passage 60 and the steam nozzle 62.

Meanwhile, when the steam generated in the sump 3 is supplied into the treating chamber 11 as described, it can be supplied through one passage. However, the steam may be supplied through a plurality of passages so that, when the steam is supplied toward the dishes received in the tub 1, a contact area and/or a contact time between the steam and the dishes can be increased. However, when the steam is supplied through the plurality of passages, it is not preferable that the number of steam supply passages keeps increasing. That is, since the inner space of the dishwasher 100 is small, the internal structure of the dishwasher must be varied to increase the number of the steam supply passages. Accordingly, according to this exemplary embodiment, a structure that can increase the steam supply passages without varying the existing internal structure of the dishwasher. This will be described hereinafter.

In the dishwasher 100 of this exemplary embodiment, the steam generated in the sump 3 can be supplied through the plurality of the steam supply passages. In more detail, the plurality of the steam supply passage includes a first passage connected to the tub 1 through the filter assembly 20 and a second passage connected to the tub 1 through a steam nozzle 62 provided in the tub 1. That is, in this exemplary embodiment, the steam generated in the sump 3 is supplied to the tub 1 through the plurality of the passages, at least one of which passes through the filter assembly. As a result, at least a portion of the steam generated in the sump housing 4 by the heater 10 can be supplied to the filter assembly 20 through a connecting passage 21. The steam supplied to the filter assembly 20 can be supplied into the tub 1 through the upper portion of the filter assembly 20 which communicates with the treating chamber 11. In addition, the rest of the steam generated in the sump housing 4 can be supplied into treating chamber 11 of the tub 1 through the steam supply passage 60 and the steam nozzle 62 as described above.

Meanwhile, when the portion of the steam is supplied through the filter assembly 20 as described above, it may be expected that the filter assembly 20 can be cleaned and sterilized by the steam. That is, as described above, the wash water supplied through the water supply unit 31 and the wash water falling from the treating chamber 11 of the tub 1 are purified by the filter assembly 20 and then supplied to the sump 3. Accordingly, the foreign substances may be accumulated in the filter assembly 20 and thus the user has to remove the accumulated foreign substances. This is troublesome for the user. However, in this exemplary embodiment, since the steam generated in the sump 3 is supplied through the filter assembly 20, the filter assembly 20 can be sterilized by the steam and the foreign substances accumulated in the filter assembly 20 can be removed by the pressure of the steam. The removed foreign substance can be drained through a drain line 22 connected to the drain portion 33 provided under the filter assembly 20.

However, when the sump housing 4 is simply connected to the connecting portion 21 and the steam supply passage 60, the steam generated in the sump housing 4 is not directed toward the steam supply passage 60 but more steam may be supplied through the connecting portion 21. This is because that the flow resistances of the steam supply passage 60 and the connecting portion 21 are different from each other.

For example, since the connecting portion 21 functions as a passage through which the wash water flows from the filter assembly 20 to the sump housing 4, the connecting portion 21 has a diameter greater than a predetermined dimension so that the wash water can smoothly flow therethrough. On the other hand, as the diameter of the steam supply passage 60 is reduced, it is advantageous to prevent the condensation of the steam flowing along the steam supply passage 60 and to spray the high pressure steam through the steam nozzle 62. When considering this, the diameter of the steam supply passage 60 may be less than the diameter of the connecting portion 21.

In this case, however, since the flow resistance of the connecting portion 21 is relatively less than that of the steam supply passage 60, a large amount (e.g., most) of the steam generated in the sump housing 4 is supplied through the connecting portion 21 rather than the steam supply passage 60. To solve this problem, in this exemplary embodiment, the inner space of the sump housing 4 may be divided into two or more sections and the steam generated in one of the sections is mainly supplied through the steam supply passage 60 so that the steam spray through the steam nozzle 62 can be effectively realized.

Figure 3A:
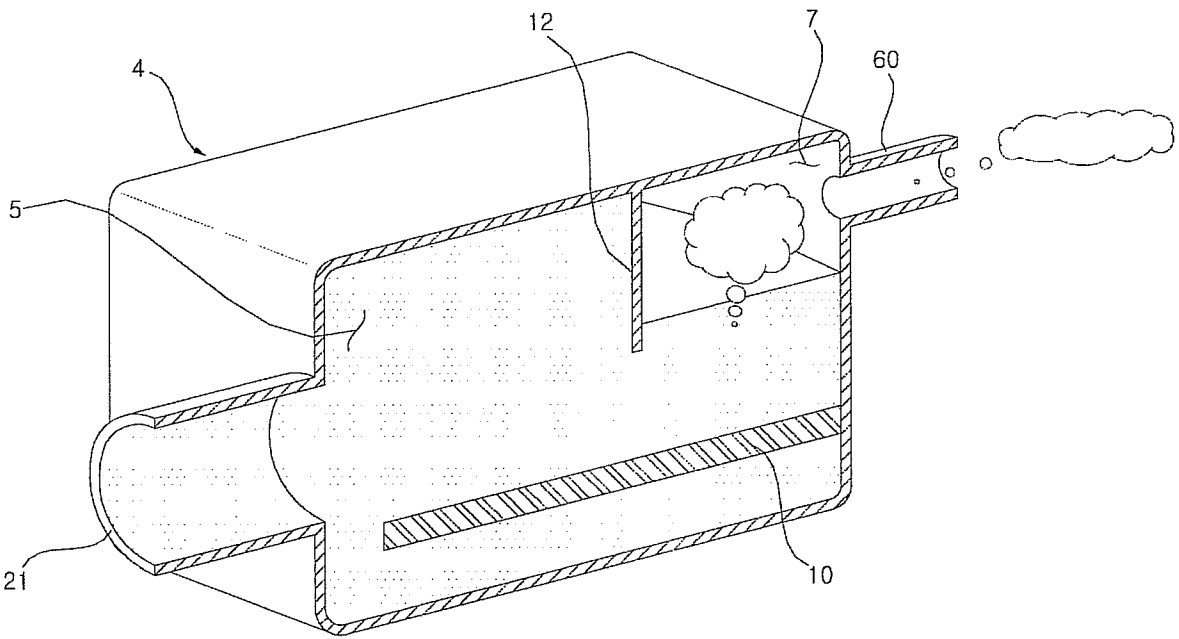
FIG. 3A is a schematic view illustrating an inner side of a sump housing depicted in FIG. 1.
Figure 3B:
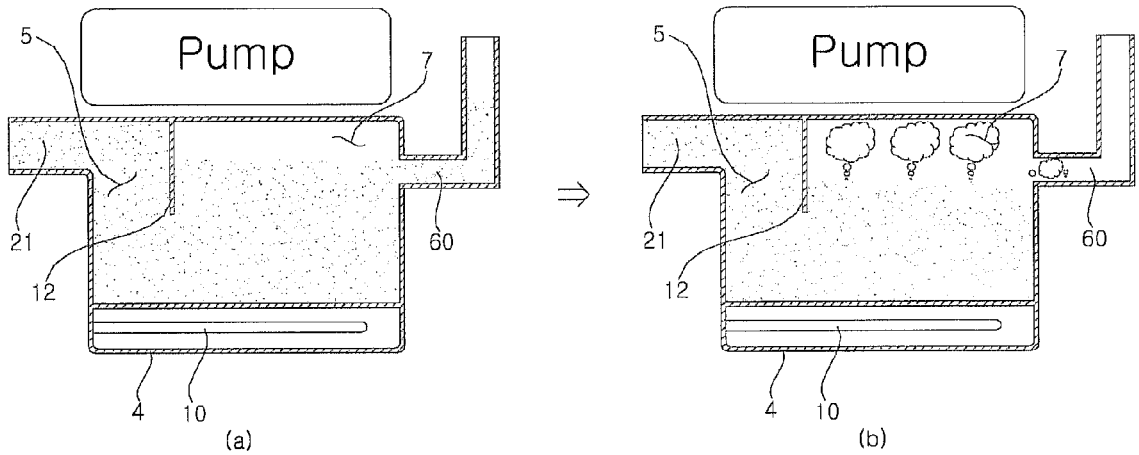
FIG. 3B is a view illustrating a process for supplying steam, which is generated by operation of a heater, to a steam supply passage according to an exemplary embodiment of the present invention.
Figure 4:
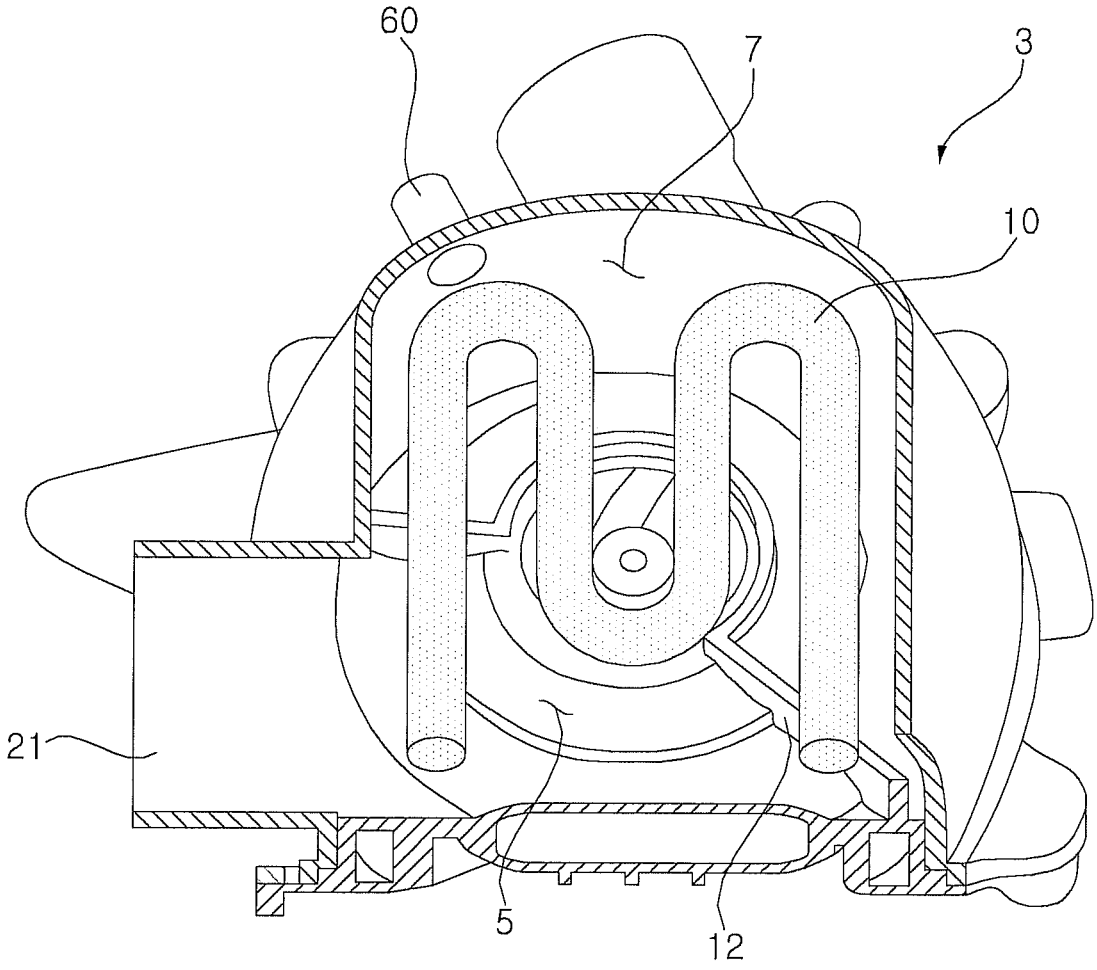
FIG. 4 is a view taken at a rear side of a sump.

FIG. 3A is a schematic view illustrating the inner side of the sump housing depicted in FIG. 1, FIG. 3B is a view illustrating a process for supplying steam, which is generated by operation of a heater, to a steam supply passage according to an exemplary embodiment of the present invention, and FIG. 4 is a view taken at a rear side of the sump.

Referring to FIGS. 3A, 3B, and 4, the sump housing 4 is provided with a barrier 12 therein. The inner space of the sump housing 4 is divided into two or more sections by the barrier 12. For example, by the barrier 12, the inner space of the sump housing 4 may be divided into a first section 5 communicating with the filter assembly 20 and a second section 7 communicating with the steam nozzle 62 through which the steam is supplied to the tub 1. That is, the inner space of the housing is divided into the first and second sections 5 and 7 by the barrier 12. The first section 5 is connected to the first passage and the second section 7 is connected to the second passage. By doing this, the steam generated in the first section 5 is supplied to the tub 1 through the first passage without being directed to the second section 7 and the steam generated in the second section 7 is supplied to the tub 1 through the second passage.

Meanwhile, the barrier 12 does not divide the inner space of the sump housing 4 into the two sections with seal. That is, the wash water in the sump housing 4 can flow between the first and second sections 5 and 7. However, when the water level in the sump housing 4 is equal to or greater than a predetermined level, the flow of the steam generated in the second section 7 to the first section 5 is suppressed. Likewise, the flow of the steam generated in the first section 5 to the second section 7 is also suppressed.

In more detail, the barrier 12 may be provided at an upper portion of the inner space of the sump housing 4. The heater 10 is provided at the lower portion of the inner space of the sump housing 4 so that it can heat the wash water regardless of the water level. In this structure, the barrier 12 protrudes from a top surface of the sump housing 4 downward. At this point, a predetermined distance remains between a bottom surface of the sump housing 4 and a lower end of the barrier 12. Therefore, the divided sections of the sump housing 4 communicate with each other. Accordingly, the first and second sections 5 and 7 are separated at the upper portion of the sump housing 4 and communicate with each other at the lower portion of the sump housing 4. In addition, as the first and second sections 5 and 7 communicate with each other, the wash water supplied from the filter assembly 20 to the first section 5 may be supplied to the second section 7 through a space defined between the bottom surface of the sump housing 4 and the lower end of the barrier 12.

Particularly, FIG. 3B plainly shows a process for supplying the steam generated in the second space 7 to the steam supply passage 60. When the wash water is supplied into the sump housing 4, since the first section 5 communicates with the treating chamber 11 through the connecting portion 21 and the resistance of the first passage including the connecting portion 21 is relatively low, the atmospheric pressure in the first section insignificantly affects on prevention of the increase of the water level. However, in the second section 7, due to the resistance of the second passage including the steam supply passage 60 and/or the steam nozzle 62, that is, the steam supply passage 60 having the small diameter than the connecting portion 21, the water pressure acting by the wash water filled in the steam supply passage 60, the effect of the steam nozzle 62, and the suppression of the movement of the fluid toward the first section 5 by the barrier 12, the second section 7 has a space unoccupied by the wash water. Therefore, as the generation of the steam keeps going, the atmospheric pressure in the unoccupied space or the steam pressure increases. Accordingly, since the second section 7 maintains the high pressure state, the steam sprayed from the steam nozzle 62 can be maintained with a high pressure at which the steam can directly contact the dishes.

FIG. 3B shows a process for forming a pressure chamber, i.e., the space unoccupied by the wash water in the second section 7 of the sump housing 4 and exhausting the steam through the steam supply passage 60 as the steam is generated by the heater 10 and thus the pressure of the pressure chamber increases. See (a) and (b) of FIG. 3B in order.

Particularly, the water level for generating the steam may be a level at which the lower end of the barrier 12 can remain under the wash water. In this case, the flow of the wash water between the first and second sections 5 and 7 is realized but the flow of the air or steam between the first and second sections 5 and 7 is suppressed.

In addition, an inlet end of the steam supply passage 60 may remain under the wash water. In this case, in an initial steam generation by the heater 10, the pressure in the second section 7 can effectively increase. In addition, due to the affection of the increased pressure in the second section 7 and the spray of the steam through the steam nozzle 62, the water level in the sump housing 4 is lower than the inlet end of the steam supply passage 60 and thus the steam spray can be more effectively realized.

Figure 5:
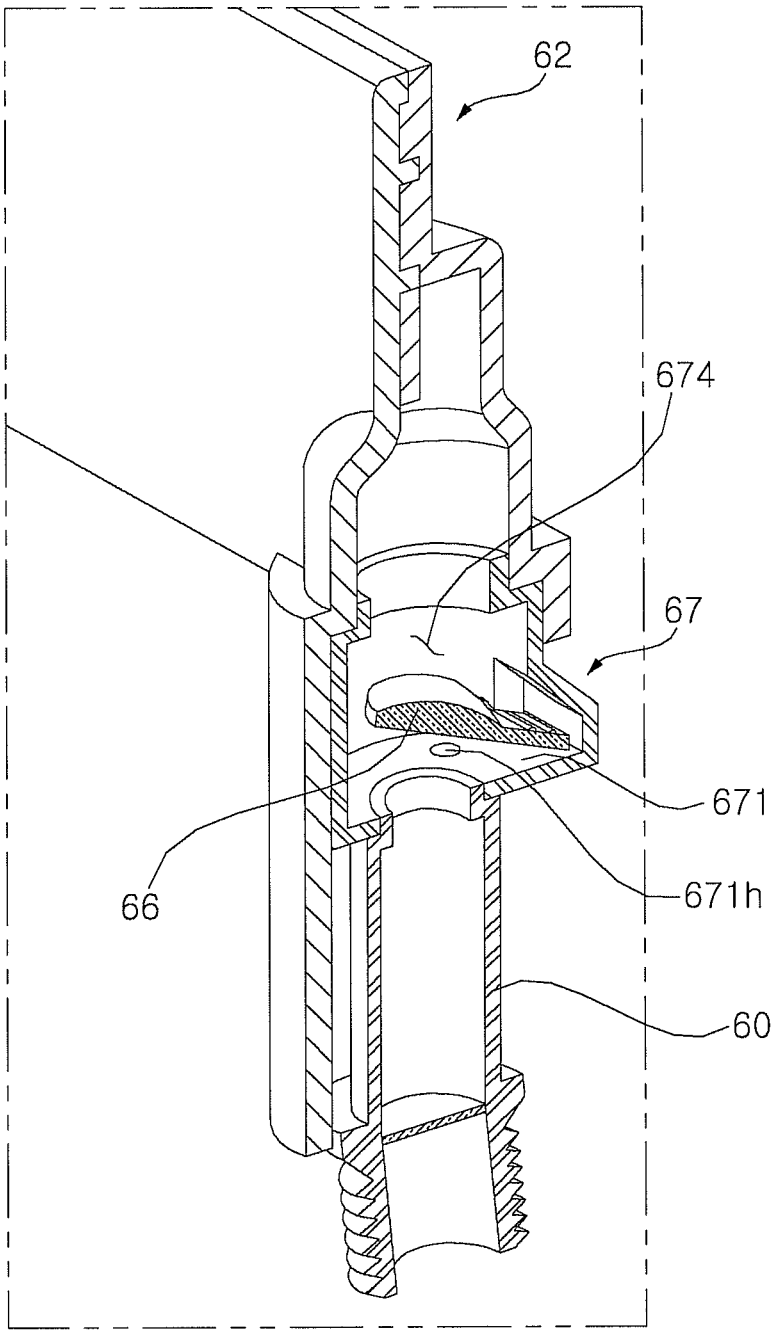
FIG. 5 is a sectional view of a passage control unit.
Figure 6:
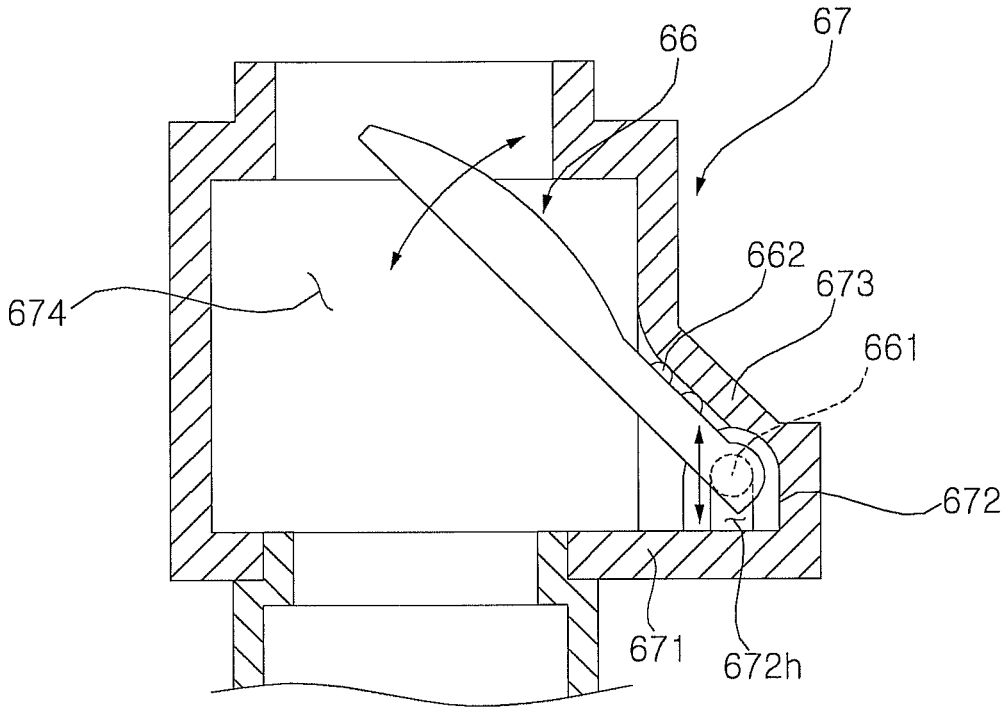
FIG. 6 is an enlarged view of a portion of FIG. 5.
Figure 7:
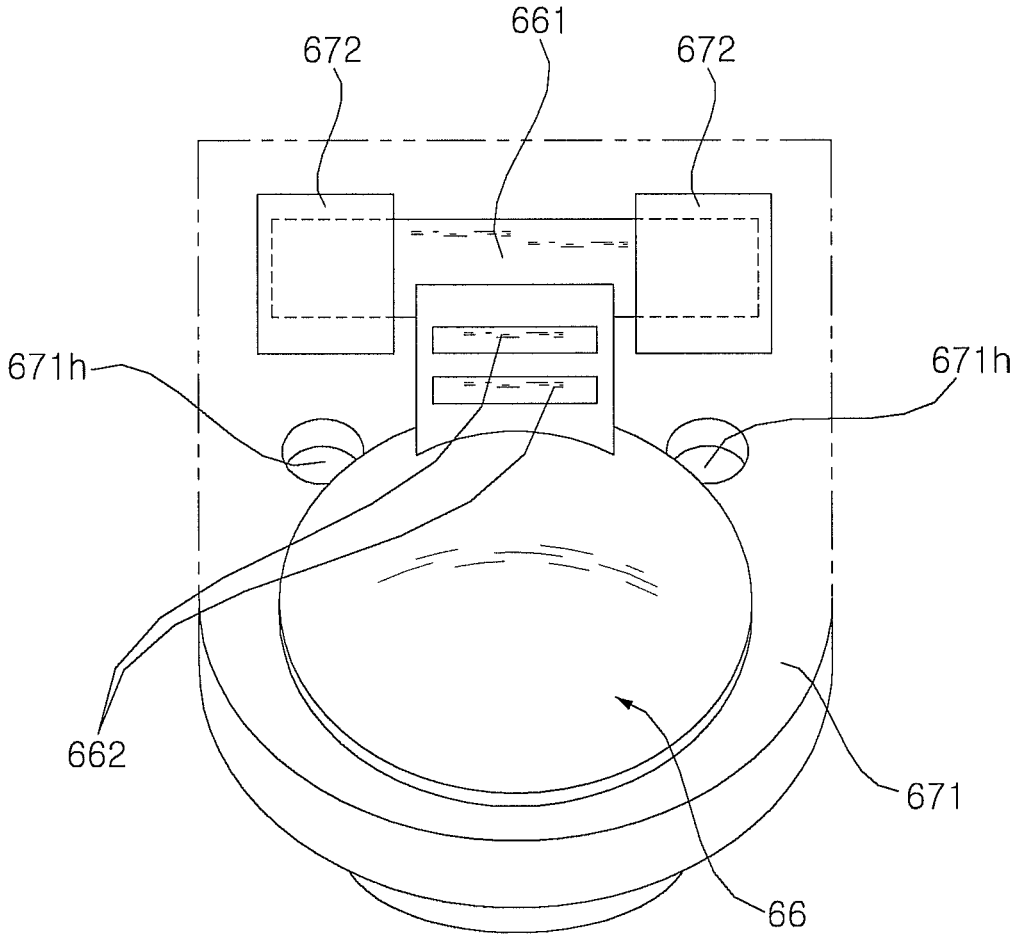
FIG. 7 is a view illustrating an inner side of a passage control unit housing of FIG. 6.

FIG. 5 is a sectional view illustrating a passage control unit. FIG. 6 is an enlarged view of a portion of FIG. 5. FIG. 7 is a view illustrating an inner side of a passage control unit housing depicted in FIG. 6.

Referring to FIGS. 5 to 7, the dishwasher 100 according to an exemplary embodiment of the present invention may include passage control unit for controlling the second passage.

The passage control unit cuts off the second passage as the supply pump 61 operates and the wash water is sprayed into the tub 1 through the lower arm 53 or the upper arm 51. On the other hand, when the steam is generated in the sump 3 by the heater 10, the passage control unit opens the second passage so that the steam can be sprayed into the tub 1 through the steam nozzle 62.

The passage control unit includes a passage control member 66 that is rotatably provided on the second passage and has a rotational shaft that can move within a predetermined distance by the pressure created by the steam. When no steam is supplied from the sump 3, the passage control member 66 is located to close the second passage. When the steam is supplied from the sump 3, the passage control member 66 rotates by the pressure created by the steam (hereinafter, referred to as "steam pressure") to open the second passage. At this point, since the passage control member 66 has the movable rotational shaft, the passage control member 66 performs not only the rotational motion but also the translation motion.

It is sufficient that the passage control member 66 moves within the second passage and thus the passage control member 66 may be located on the steam supply passage 60 or the steam nozzle 62, which constitute the second passage.

The passage control unit further includes a passage control unit housing 67. The passage control unit housing 67 defines a space 674, in which the passage control member 66 in the second passage operates, and supports the passage control member 66. The passage control unit housing 67 may be integrally formed with one of the steam supply passage 60 and the steam nozzle 62. However, as shown in FIGS. 5 to 7, the passage control unit housing 67 is separately formed from the steam supply passage 60 and the steam nozzle 62 and connects the steam supply passage 60 to the steam nozzle 62. This will be described in more detail with reference to FIGS. 5 to 7.

The passage control member 66 is rotatably provided in the passage control unit housing 67. When no steam is supplied from the sump 3, e.g., when the supply pump 61 operates to wash the dishes, the passage control member 66 closes the steam supply passage 60, i.e. the second passage. Accordingly, the flow of the air introduced from the steam nozzle 62 toward the sump 3 along the steam supply passage 60 can be prevented. This means that the air introduction toward the supply pump 61 through the steam supply passage 60 is suppressed and thus the reduction of the pump pressure of the supply pump can be prevented.

On the other hand, when the steam generated in the sump 3 by the heater 10 flows along the steam supply passage 60, the passage control member 66 is opened by the steam pressure. At this point, since the passage control member 66 performs the rotational motion and the translation motion simultaneously, the passage control member 66 can be more effectively move as compared with the case where only the rotational motion is possible.

In more detail, the passage control unit housing 67 is provided with a rotational shaft supporting portion 672 for supporting the passage control member 66. A rotational shaft 661 of the passage control member 66 can move within a predetermined distance in a state where it is coupled to the rotational shaft supporting portion 672. The rotational shaft supporting portion 672 may be provided with a hole **672*h* or groove in which the rotational shaft 661 is inserted. The hole or groove has a predetermined length along which the rotational shaft 661** can move within the predetermined distance.

The rotational shaft supporting portion 672 may protrude from a bottom surface 671 of the passage control unit housing 67. Here, the bottom surface 671 is formed around an outlet of the steam supply passage 60 so that condensed water that is generated by the condensing of the steam when the steam supply passage 60 is closed is collected on the bottom surface 671.

Meanwhile, when the passage control member 66 operates in an opening direction by the steam pressure and a rotational angle from an initial position (i.e., a position for closing the steam supply passage 60) to a complete opening position is referred to as an opening angle, there is a need to limit the opening angle with in a predetermined range. That is, when the supply of the steam stops, the passage control member 66 returns to the initial position by its self-gravity to close again the steam supply passage 60. However, when the opening angle goes over the predetermined range, the returning of the passage control member 66 becomes impossible. Therefore, the opening angle should be set within a range within which the passage control member 66 returns to the initial position by its self-gravity when the supply of the steam stops. Needless to say, depending on an initial state of the passage control member 66 in the initial position, the returning operation of the passage control member 66 may be possible even when the opening angle is equal to or greater than 90 degree. However, in order to secure the passage when the passage control member 66 operates in an opening direction, it is preferable that the passage control member 66 is horizontally disposed rather than vertically disposed. Therefore, the opening angle may be set within 90 degree so that the passage control member 66 can effectively return from the opening position to the initial position when the supply of the steam stops even when the structure is that the initial position of the passage control member 66 deviates more or less from the horizontal plan.

The opening operation of the passage control member 66 is limited to an opening angle by the contact with an inner surface of the passage control unit housing 67. In this exemplary embodiment, the opening operation of the passage control member 66 is limited as it contacts a limit surface 673 that is inclined with respect to a horizontal surface.

A protrusion 662 may be formed on at least one of the passage control member 66 and the limit surface 673. In this case, in a state where the passage control member 66 rotates to the opening angle, the contact between the passage control member 66 and the limit surface 673 is realized by the protrusion 662 and thus the contact area between the passage control member 66 and the limit surface 673 can be reduced. In addition, when the supply of the steam stops, the problem that the passage control member 66 adhered to the limit surface 673 and thus the passage control member 66 cannot return to the initial position can be prevented.

Meanwhile, when the supply of the steam stops after the steam spray through the steam nozzle 62 is completed, the passage control member 66 returns to the initial position to close the steam supply passage 60. Then, as time goes, the temperature of the humid air in the second passage, particularly, the humid air existing between the passage control member 66 and the steam nozzle 62 is gradually reduced and thus condensed into the water. This water is collected in the passage control unit housing 67. When leaving the water, sanitary problem may occur, Accordingly, a water exhausting hole 671*h* communicating the second passage with the inside of the tub 1 may be formed so that the water generated by the condensation of the steam can be exhausted out of the second passage. In this exemplary embodiment, at least one water exhaust hole 671*h* is formed on the bottom surface 671 of the passage control unit housing 67.

The passage control member 66 may be formed of a flexible material such as natural rubber, synthetic resin, and the like.

Meanwhile, in a washing cycle including a rinsing cycle, the water level in the tub 1 reaches a predetermined level by the wash water sprayed through the nozzle arms 51 and 53. When a level of the water exhaust hole 671*h* is higher than the water level in the tub 1, the wash water may be introduced into the second passage through the water exhaust hole 671*h*. In order to prevent this, the water exhaust hole 671*h* may be formed at a location higher than a water supply allowable level. The water level of the tub 1 may be differently set depending on processing cycles or an amount of the dishes. Therefore, the water supply allowable level means a maximum value among the water levels of the respective cycles, which are set to possibly perform the respective cycles of the dishwasher.

When considering another aspect, since the water exhaust hole 671*h* is always exposed to the air, the air flow between the water exhaust hole 671*h* and the steam nozzle 62 is effectively realized and thus the condensation of the steam for generating the water can be effectively promoted.

According to the present invention, since the steam is generated by the heater provided in the sump, no additional device for generating the steam is required. Accordingly, it becomes possible to generate and supply the steam using a simple structure.

In addition, the steam generated in the sump is supplied into the tub through a plurality of passages and at least one of the plurality of the passages passes through the filter assembly. Accordingly, since the steam is supplied through the plurality of the passages, the contact area and/or contact time between the steam and the dishes increase and thus the washing effect can be improved.

Further, since at least a portion of the steam is supplied to the tub through the filter assembly, the foreign substances accumulated in the filter assembly can be removed and the filter assembly can be sterilized.

Figure 8:
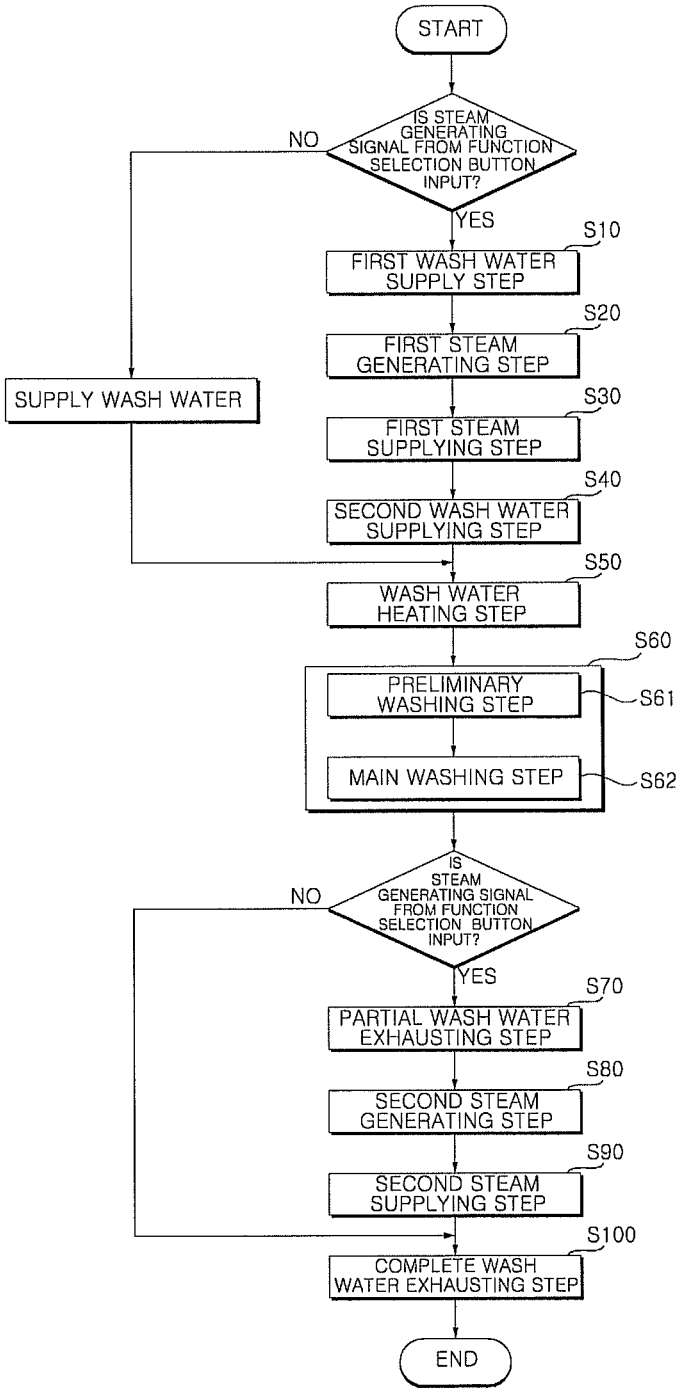
FIG. 8 is a block diagram illustrating a control method of a dishwasher according to an exemplary embodiment of the present invention.

A method of controlling the dishwasher according to an exemplary embodiment of the present invention will be described in detail with reference to FIG. 8.

First, when the user manipulates the control panel CP by pressing a normal function button, the wash water is supplied from the water source into the sump 3 through the water supply unit 31 by an amount that can wash the object to be washed (hereinafter, referred to as "tableware").

At this point, the amount of the wash water supplied corresponds to an amount of the wash water that is at least required for all of steps of a standard washing process S60 of the dishwasher. For example, the washing process of the dishwasher is a process for removing dirt from the tableware. That is, the washing process includes a preliminary washing step S61 for primarily remove the dirt from the tableware, a main washing step S62 for removing all of the dirt from the tableware after the preliminary washing step S61, and a rinsing step (not shown) for completely removing residing dirt from the tableware after the main washing step S62.

In the present invention, the standard washing process S60 performed by manipulating the normal function button is defined as it includes only the preliminary washing step S61, the main washing step S62, and the rinsing step.

When a predetermined amount of the wash water is supplied to the sump 3 (hereinafter, the amount of the wash water will be referred to as "Q1+Q2" in order to distinguish between this amount and an amount that is primarily supplied by manipulating a steam generating function button and a sterilizing function button that will be described later), the supplied wash water is heated to a predetermined temperature (hereinafter, the predetermined temperature will be referred to as "a second predetermined temperature" in order to distinguish between the second predetermined temperature and a first predetermined temperature to which the wash water is heated when the steam generating function button and the sterilizing function button are selected). The second predetermined temperature may be set such that the heated wash water can effectively perform the preliminary washing step S61, the main washing step S62, and the rinsing step.

When the wash water stored in the sump is heated by the heater 10 to the second predetermined temperature, the heated wash water is sprayed to the tableware received in the upper and lower racks 41 and 43 by the respective upper and lower arms 51 and 53 through the spray arms 51 and 53 at each step, thereby washing the tableware.

Finally, when the washing process S60 is completed, the wash water is drained out of the sump 3 through the drain unit 33 (S100).

However, the control method of the dishwasher according to the present invention may further include a variety of other washing processes in accordance with a variety of function buttons as well as the washing process S60.

For example, a steam swelling function for swelling the dirt adhered to the tableware may be performed by manipulating the steam swelling function button before the standard washing process (including the preliminary washing step, the main washing step, and the rinsing step). In addition, the tableware may be sterilized by manipulating a sterilizing function button after the standard washing process.

According to an exemplary embodiment of the control method of the dishwasher of the present invention, when the steam swelling function button is manipulated, a first wash water supply step S10 for supplying the wash water to the sump 3 by an amount Q1 is performed.

Here, the first wash water supply step S10 is for supplying the wash water by the amount Q1 to the sump when the amount of the wash water required for the standard washing process S60 is the "Q1 and Q2."

Next, a first steam generating step S20 for generating the steam by allowing the heater 10 to heat the wash water supplied in the first wash water supplying step S10 to the first predetermined temperature is performed.

In the first steam generating step S20, the first predetermined temperature will be a temperature that can generate the steam capable of performing the steam swelling function at least.

The steam generated in the first steam generating step S20 is sprayed into the tub 1 in a first steam supply step S30. That is, The steam is sprayed toward the tableware in the tub 1 through the plurality of the steam passages (i.e., the first passage communicating with the tub 1 through the filter assembly 20 and the second passage communicating with the tub 1 through the steam nozzle 62 provided in the tub 1) to perform the steam swelling function.

Next, a second wash water supply step S40 for additionally supplying the wash water by the amount Q2 to the sump after the first steam supply step S30.

Here, the second wash water supply step S40 is for optimally adjusting an amount of the wash water required for performing the standard washing process S60. That is, the wash water is supplied by the amount Q2 to the sump 3 in addition to the wash water (Q1) that is already supplied for the first steam generating step S20 and the first steam supply step S30. Therefore, an amount (Q1+Q2) of the wash water is finally supplied to the sump 3. The amounts Q1 and Q2 may be varied depending on a shape and type of the sump 3. However, the amount Q1 for performing the steam swelling function is generally less than the amount Q2.

The wash water supplied in the second wash water supply step S40 is heated to the second predetermined temperature by the heater 10 in a wash water heating step S50.

Here, the second predetermined temperature is a temperature at which the standard washing process S60 can be optimally performed. The second predetermined temperature is lower than the first predetermined temperature.

In a prior art, the wash water is supplied by the amount Q1+Q2 for the steam swelling function and the amount Q1+Q2 of the wash water is heated to the first predetermined temperature higher than the second predetermined temperature by the heater 10 to perform the steam welling function. Therefore, the heating time of the wash water by the heater 10 increases and thus the washing time also increases. Furthermore, the energy consumption also increases. To solve this limitations of the prior art, in the exemplary embodiment of the present invention, The steam swelling process and the standard washing function are separated from each other and the amount of the wash water is adjusted depending on the processes, thereby remarkably reducing the washing time and the energy consumption.

Meanwhile, the control method of the dishwasher according to the exemplary embodiment of the present invention may further include, after the standard washing process, a partial wash water exhausting step S70 for exhausting the wash water out of the sump 3 while remaining a small amount of the wash water in the sump 3.

The standard washing process S60 has the same means as the above-described standard washing process including the preliminary washing step, the main washing step, and the rinsing step.

However, it is not necessary to perform the partial wash water exhausting step S70 after the standard washing process. That is, the performing of the partial wash water exhausting step S70 may be determined depending on whether the user manipulates the sterilizing function button.

For example, when only the standard washing process S60 is required, there is no need to perform the partial wash water exhausting step S70 for partly exhausting the wash water. Accordingly, when no steam generating signal generated by the user manipulating the sterilizing function button is input, the wash water is completely exhausted out of the sump 3 (a complete wash water exhausting step S100).

However, when the steam generating signal generated by the user manipulating the sterilizing function button is input, as described above, the partial wash water exhausting step S70 is performed.

The amount of the wash water remaining in the sump 3 after the partial wash water exhausting step S70 is identical to the amount Q1 of the wash water supplied to the sump 3 in the first wash water supply step S10. The remaining wash water is for performing the sterilizing function instead of the steam swelling function. That is, the remaining wash water is for generating the steam by the heater 10 like in the first steam generating step S20.

That is, the control method of the dishwasher according to the exemplary embodiment of the present invention further includes, after the partial wash water exhausting step, a second steam generating step S80 for heating the wash water remaining in the sump 3 to the first predetermined temperature using the heater 10 and a second steam supply step S90 for spraying the generated steam into the tub 1.

Here, the second steam supply step S90 may be a sterilizing step for sterilizing the tableware using the steam before a tableware drying step (not shown) for drying the tableware in the tub 1.

As described above, when the sterilizing function is completed in the second steam supply step S90, a complete wash water exhausting step S100 for completely exhausting the wash water out of the sump 3 is performed, thereby completing the washing process of the dishwasher according to the present invention.

According to circumstances, the drying step for drying the tableware in the tub 1 using hot wind may be performed.

According to the control method of the dishwasher of the exemplary embodiment of the present invention, by limiting the amount of the wash water supplied to the sump in the steam swelling step, the energy consumption can be reduced as compared with the case where all of the wash waster stored in the sump for the washing process is heated, thereby improving the energy efficiency.

In addition, when there is a need to sterilize the tableware using the high temperature steam immediately after completing the standard process of the dishwasher, the wash water is partly exhausted and thus the wash water that is used for the washing process can be utilized, thereby reducing the energy consumption.

Hereinafter, a dishwasher 700 according to another exemplary embodiment of the present invention will be described. The dishwasher 700 includes same elements as the foregoing exemplary embodiment. The same elements will be assigned with the same names but different reference numerals. However, although the same elements are assigned with the same names, the structures thereof may be slightly different from each other. Nevertheless, it should be understood that the same elements perform the same functions.

Figure 9:
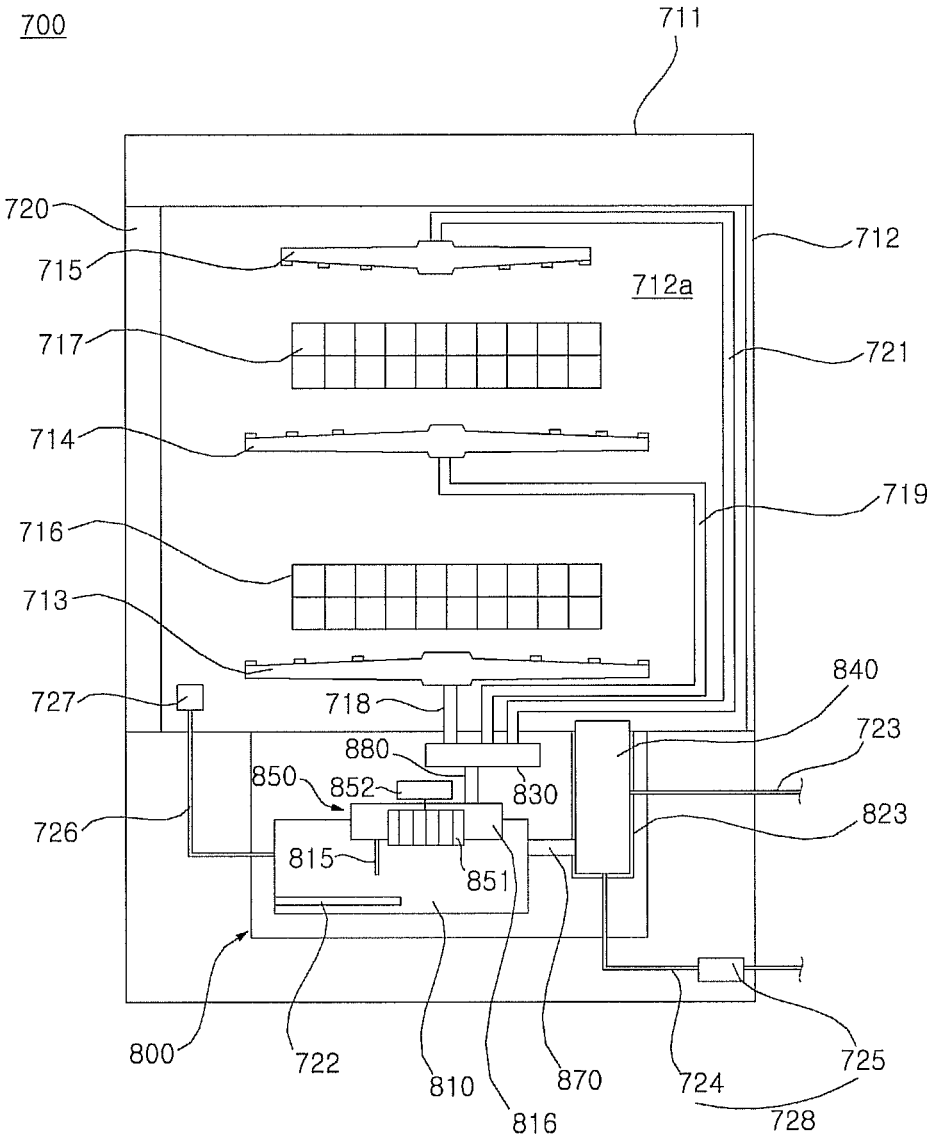
FIG. 9 is a view of a dishwasher according to another exemplary embodiment of the present invention.
Figure 10:
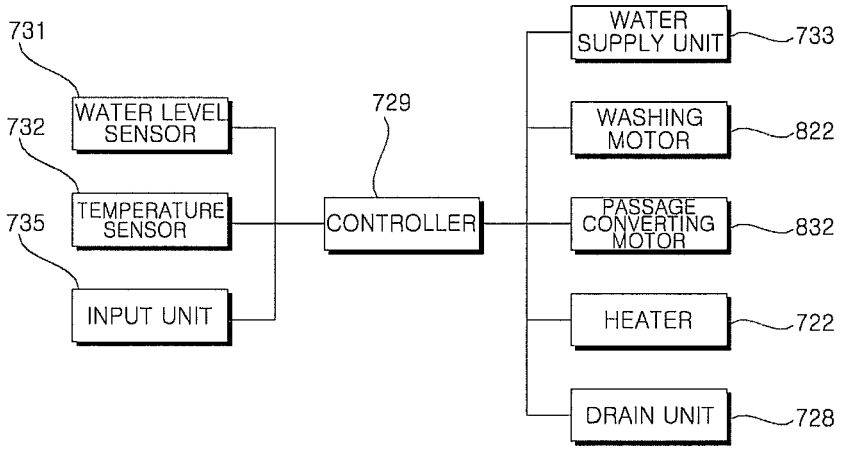
FIG. 10 is a block diagram illustrating a control relationship between constitutional elements of the dishwasher of FIG. 9.
Figure 11:
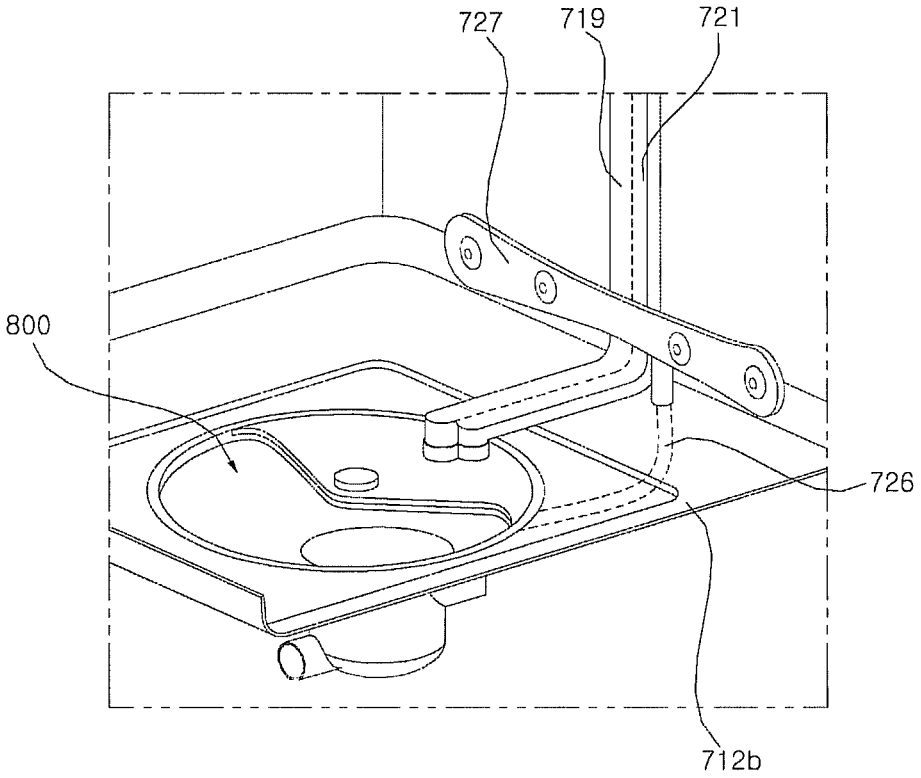
FIG. 11 is a perspective view of an inner side of a tub of FIG. 9.
Figure 12:
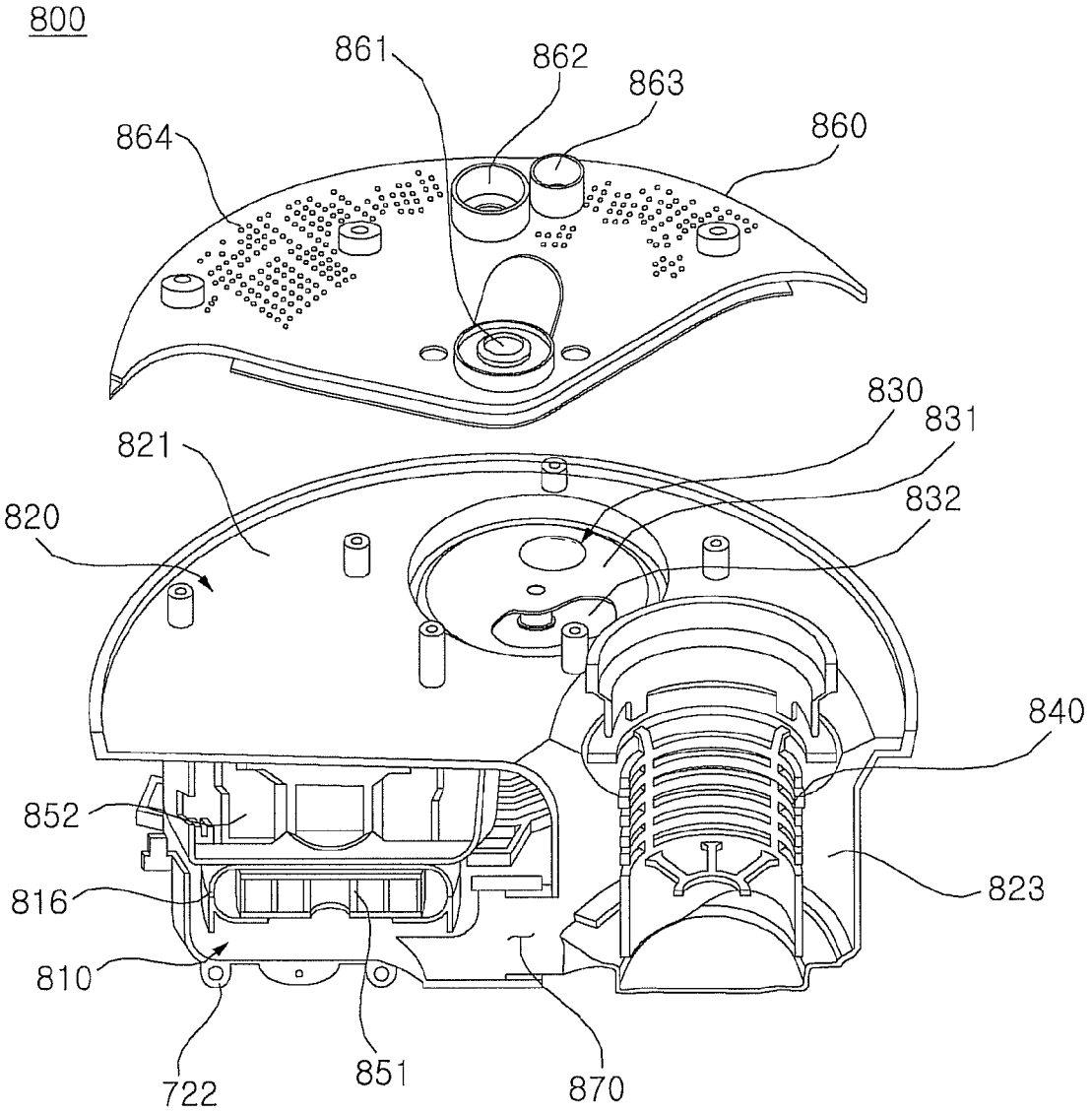
FIG. 12 is an exploded perspective view of a sump depicted in FIG. 11.
Figure 13:
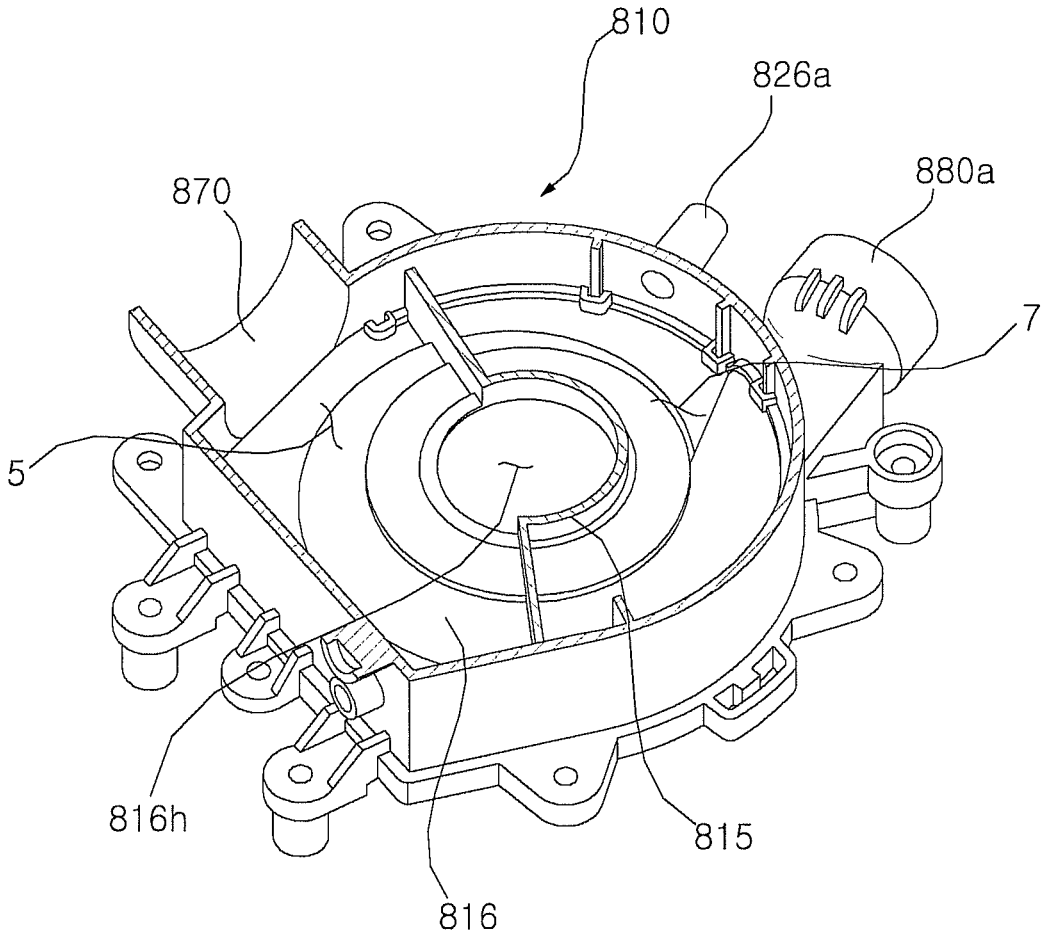
FIG. 13 is a sectional view of a barrier formed in a sump of FIG. 11.

FIG. 9 is a view of a dishwasher according to another exemplary embodiment of the present invention, FIG. 10 is a block diagram illustrating a control relationship between constitutional elements of the dishwasher of FIG. 9, FIG. 11 is a perspective view of an inner side of a tub of FIG. 9, FIG. 12 is an exploded perspective view of a sump depicted in FIG. 11, and FIG. 13 is a sectional view of a barrier formed in a sump of FIG. 11;

Referring to FIGS. 9 to 11, the dishwasher 700 according to the another exemplary embodiment of the present invention includes a cabinet 711 defining an outer appearance of the dishwasher 700, a tub 712 in which the tableware is received and which provides a treating chamber 712*a* in which the wash water and steam is supplied to wash the tableware, and a door 720 for opening and closing the treating chamber 712*a*.

Lower and upper racks 716 and 717 for supporting the tableware, first, second, and third spray nozzles 713, 74, and 715 for spraying the wash water toward the tableware supported on the racks 716 and 717, and a steam nozzle 727 for spraying steam into the treating chamber 712*a*.

The lower rack 716 is provided at a lower portion of the treating chamber 712*a* and the first spray nozzle 713 sprays the wash water from a lower side to an upper side toward the lower rack 716. The upper rack 716 is provided at an upper portion of the treating chamber 712*a* and the second spray nozzle 714 sprays the wash water from the lower side to the upper side toward the upper rack 717. The third spray nozzle 715 sprays the wash water from the upper side to the lower side toward the upper rack 717.

The steam nozzle 727 is connected to the sump 800 through a steam supply passage 26. The steam generated by a heater 722, which is provided to heat the wash water stored in a reservoir 810 is supplied to the steam nozzle 727 through the steam supply passage 26.

The first, second, and third spray nozzles 713, 714, and 715 are supplied with the wash water from the sump 800 through first, second, third spray nozzle connecting passages 718, 719, 721, respectively.

The sump 800 includes the reservoir 810 in which the wash water is collected. The wash water stored in the reservoir 810 is directed by pressure toward the first, second, and third spray nozzles 713, 714, and 715 by a pump 850. Particularly, when the pump 850 operates, the wash water is sprayed into the tub 712 and the wash water collected on a bottom of the tub 712*b* is introduced again into the sump 800, thereby realizing the circulation of the wash water between the sump 800 and the tub 712. Accordingly, the sump 800 communicates with the inside of the tub through the steam nozzle 726 and further communicates with the tub through a path along which the wash water is introduced from the tub.

In more detail, the dishwasher includes a filter 840 for removing foreign substances such as garbage suspending in the wash water. The filter 840 is disposed in a path along which the wash water is introduced from the tub 712 into the sump 800. To this end, a filter mounting portion 823 on which the filter 840 is mounted is formed on the sump 800. Therefore, the sump 800 communicates with the tub 712 through not only the steam nozzle 727 but also the filter mounting portion 823. A passage 870 connects the filter mounting portion 823 to the reservoir 810.

A path along which the steam generated when the wash water in the sump 800 is heated by the heater 722 includes a first passage provided through the steam supply passage 726 and the steam nozzle 727 and a second passage provided through the filter mounting portion 823. Particularly, since the filter 840 is mounted on the second passage, the filter can be sterilized by the steam.

The filter mounting portion 823 may be depressed into the sump 800 so that the wash water introduced from the tub 712 can be effectively collected therein. This structure allows the filter to be easily mounted and dismounted.

A water supply unit 733 is connected to an external water source such as a water tap to supply the wash water into the sump 800. The water supply unit 733 may include a water supply passage 723 along which the wash water supplied from the external water source flows and a water supply valve (not shown) for controlling the water supply passage 723. In this exemplary embodiment, the water supply passage is directly connected to the sump and is directed toward the reservoir 810 through the filter 840. However, the present invention is not limited to this structure. For example, the water supply into the tub 712 may be directly realized through the water supply passage 723. In this case, the wash water is directed from the tub to the water storing unit via the filter mounting portion 823 and the filter 840.

A drain unit 728 is for draining the wash water in the sump 800 out of the dishwasher. The drain unit 728 may include a drain pump 725. In this exemplary embodiment, the filter mounting portion 823 is connected to a drain passage 724. When the drain pump 725 operates, the wash water passing through the filter 840 is drained out of the dishwasher 700 through the drain passage.

A pump 850 is for forcedly directing the wash water collected in the reservoir 810 to one of the spray nozzles 713, 714, and 715. The pump 850 may include a wash motor 852 and an impeller 851 rotating by the wash motor 852.

Meanwhile, although FIG. 9 schematically illustrates a disposition relationship between major elements of the dishwasher, the present invention is no limited to this relationship. For example, although the wash motor 852 is disposed in the sump 800, this is just because of difficulty in illustrating theses elements. That is, other embodiments will be also possible.

In this exemplary embodiment, the wash motor 852 is disposed at an outer side of the sump 800, i.e., between the reservoir 810 and a water collecting plate 821 (see FIG. 12) to improve space utilization in the cabinet 711, thereby increasing the capacity of the wash chamber 712*a*.

A water level sensor 731 is for detecting an amount of the wash water supplied for the wash. In order to detect the water level in the sump 800, the water level sensor 731 may be installed in the sump 800. Alternatively, the water level sensor 731 may be installed in the tub 712 to detect the water level of the tub 712.

Alternatively, a sensor may be installed in a path along which the wash water supplied to the sump 800 flows to detect an amount of the wash water. Based on the detected amount of the wash water, it is possible to assume an amount of the wash water consumed for washing or rinsing the tableware.

A temperature sensor 732 is for detecting a temperature of an inner surface of the tub 712. The temperature sensor 732 may be provided to directly detect the temperature of the inner surface of the tub 712. However, the present invention is not limited to this. When the temperature sensor 732 is provided to detect a temperature other elements rather than the inner surface of the tub 712, it is sufficient to assume the temperature of the inner surface of the tub 712 from the temperature detected. In a sterilizing course provided by the dishwasher of the exemplary embodiment of the present invention, the temperature of the inner surface of the tub 712 should increase to a predetermined level, at which pathogenic bacteria and microorganisms dies out, by the steam supplied into the tub 712. The steam temperature is generally greater than 100° C. Therefore, when a temperature of an internal air of the tub is measured by the temperature sensor, it may be difficult to assume the temperature of the inner surface of the tub based on the temperature of the internal air of the tub.

However, the temperature sensor 732 is not an essential element for achieving the purpose of the present invention. Even when no temperature sensor is provided or it is difficult to assume the temperature of the inner surface of the tub 712 using the temperature sensor, it is obvious that the temperature of the inner surface of the tub increases as the time for supplying the steam into the tub increases and thus the temperature variation of the inner surface of the tub in accordance with the steam supply time can be sufficiently attained through tests. Accordingly, in accordance with correlation between the steam supply time into the tub 712 and the temperature variation of the inner surface of the tub, which are attained through the tests, the time required for supplying the steam into the tub in the sterilizing course can be set such that the temperature of the inner surface of the tub satisfies the sterilizing conditions for killing the pathogenic bacteria and microorganisms.

An input unit 735 is for receiving a variety of control orders from the user to control the operation of the dishwasher 700. The input unit 735 may be provided through a control panel 900 (see FIG. 14). The input unit 735 may be provided in the form of a button, a dial, or a touch pad, a touch screen, and the like.

Particularly, the user can select and input the sterilizing course through the input unit 735. When the sterilizing course is selected through the input unit 735, the water supply unit 733, the heater 722, the pump 850, the drain unit 728, and the like operate in accordance with the control of the controller 729 and the sterilizing course is performed according to a preset algorithm.

The controller 729 is for controlling the elements constituting the dishwasher 700. That is, the controller 729 controls the whole operation of the dishwasher 700. Hereinafter, terms "control" and "set" used in relation to the operation of each part are in connection with the controller 729.

Referring to FIG. 12, the sump 800 may include a sump housing 820 and a sump cover 860. The water collecting portion 810 and the filter mounting portion 823 are formed on the housing 820. The sump cover 860 is provided above the sump housing 820 and is provided with a plurality of pores 864 through which the wash water introduced into the sump housing 820 can pass.

In addition, the sump cover 860 includes a first connecting member 861 connected to a first spray nozzle connecting passage 718, a second connecting member 862 connected to a second spray nozzle connecting passage 719, and a third connecting member 863 connected to a third spray nozzle connecting passage 721.

A passage converting unit 830 is for selectively supplying the wash water supplied by the pump 850 to one of the first, second and third spray nozzles 713, 714, and 715.

In more detail, the sump housing 820 is provided with a wash water supply passage 880 along which the wash water supplied by the pump 850 flows. The passage converting unit 830 controls the wash water directed toward the spray nozzles 713, 714, and 715 through the wash water supply passage 880. As described above, the plurality of the spray nozzles 713, 714, and 715 may be provided. In this case, by the operational control of the passage converting unit 830, the wash water is selectively supplied to at least one of the spray nozzles 713, 714, and 715.

The passage converting unit 830 includes a passage converting motor 832 and a rotational plate 831 rotating by the passage converting motor 832. The rotational plate 831 is provided with at least one hole.

When the hole of the rotational plate is located to correspond to at least one of the connecting members 861, 862, and 863 in accordance with the rotational control of the passage converting motor 832, the wash water supplied through the wash water supply passage 880 is sprayed through the at least one of the spray nozzles 713, 714, and 715. That is, the wash water is sprayed through the one of the spray nozzles that communicates with the wash water supply passage 880 by the hole formed on the rotational plate 831.

Meanwhile, the rotation of the rotational plate 831 is controlled by the passage converting motor 832 by stages. The passage converting motor 832 may be a step motor that advances by a predetermined angle whenever an exciting state varies by an input pulse signal and maintains a predetermined location when the exciting state is not varied.

Referring to FIGS. 9 and 13, the sump housing 860 is provided with a flow guide portion 816 that encloses the impeller 851 and guides the flow of the wash water exhausted between blades of the impeller. The flow guide portion 816 is connected to the wash water supply passage 880. A connecting member 880*a* formed on the flow guide portion 816 of FIG. 13 is for connecting with the wash water supply passage 880.

As described above, the steam generated in the sump 800 by the heater 722 is partly sprayed into the tub 712 through the steam nozzle 727 and partly supplied into the tub through the filter mounting unit 823. At this point, in order to allow the steam generated in the sump 800 to flow to both the steam nozzle 727 and the filter mounting portion 823, the inner space of the sump 800 may be divided. To this end, a barrier 815 is formed on a rear surface of the flow guide portion 816 enclosing the impeller 851. The barrier 815 protrudes from the rear surface of the flow guide portion 816 toward the water collecting unit 810. In addition, a portion of the barrier 815 is formed around an inlet 816*h* of the pump 850 and thus the inlet 816*h* of the pump 850 is located at one of divided sections of the inner space of the sump 800 divided by the barrier 815. In addition, the other of the divided sections of the inner space of the sump communicates with the steam supply passage 726. A connecting member 726*a* of FIG. 13 is connected to the steam supply passage 726.

In more detail, the barrier 815 may be provided at an upper portion of the inner space of the reservoir 810. The barrier 815 does not completely divide the inner space of the reservoir 810 such that the divided sections can communicate with each other. As shown in FIG. 13, the barrier 815 may extend downward from the rear surface of the passage guide portion 816 defining a top surface of the reservoir 810 by a predetermined length. Accordingly, the inner space is divided into first and second sections 5 and 7 by the barrier 815. The first and second sections 5 and 7 communicates with each other through a space defined between a lower end of the barrier 815 and a bottom surface of the reservoir 810. The wash water passing through the filter assembly 840 is filled in both the first and second sections.

Meanwhile, the heater 722 is for simply heating the wash water stored in the reservoir 810. Therefore, the heater 722 may be provided to be exposed to the wash water contained in the reservoir 810. Alternatively, the heater 722 may be buried in the sump housing 820 as shown in FIG. 12.

Figure 14:
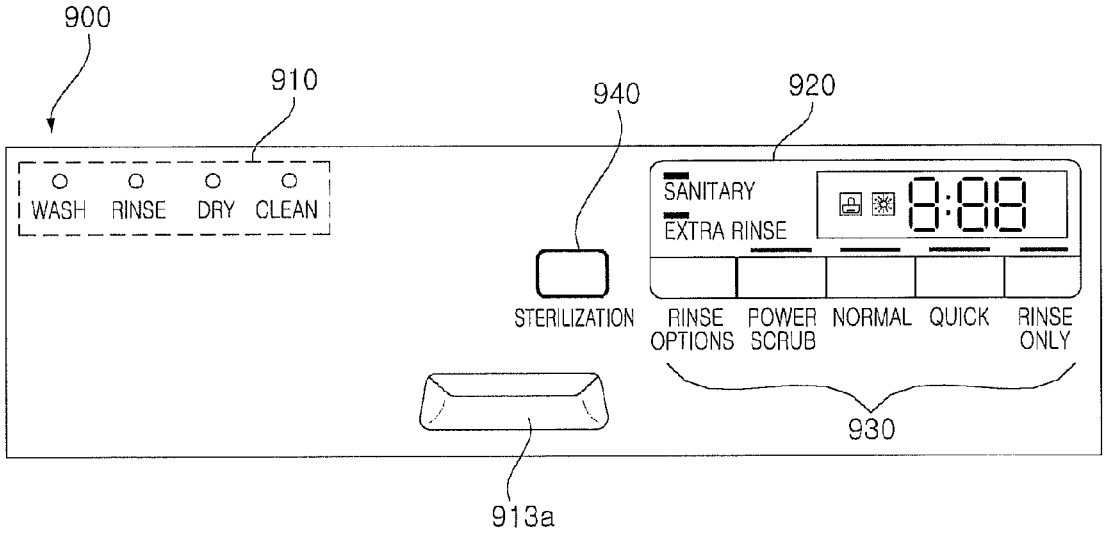
FIG. 14 is a view of a control panel of the dishwasher of FIG. 9.
Figure 15:
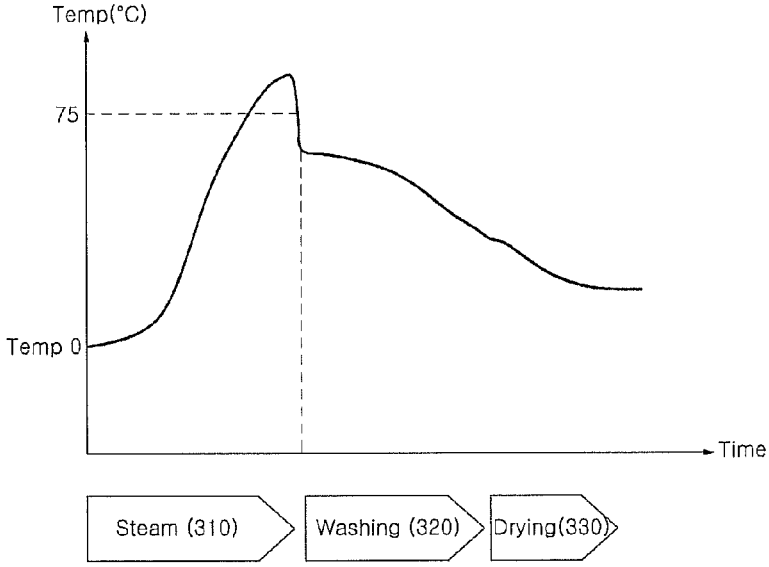
FIG. 15 is a graph illustrating a temperature variation of a inner surface of a tub according to a structure of a sterilization course and a proceed of the sterilization course of the dishwasher of FIG. 9.

FIG. 14 is a view of a control panel of the dishwasher of FIG. 9, FIG. 15 is a graph illustrating a temperature variation of a inner surface of a tub according to a structure of a sterilization course and a proceed of the sterilization course of the dishwasher of FIG. 9, FIG. 16 is a table illustrating a variety of courses supplied by the dishwasher of FIG. 9, and FIG. 17 is a table illustrating sterilization conditions by heating depending on types of microorganisms and types of pathogenic bacteria.

Referring to FIG. 14, the dishwasher 700 according to the exemplary embodiment of the present invention includes the control panel 900 providing the input unit 735.

In this exemplary embodiment, the control panel 900 is provided at an upper portion of the door 720. However, the present invention is not limited to this. For reference, a handle 720*a* of FIG. 14 is for opening and closing the door 720.

The control panel 900 is provided with manipulation keys 930 and 940 constituting the input unit 735, an indicator 910 indicating a current cycle, and a display unit 920 for displaying information on the whole operation of the dishwasher 700. The indicator 910 includes a plurality of light emitting portions that turn on and off in accordance with the current cycle. That is, the light emitting portions turn on and off in accordance with a proceeding state of the washing, rinsing, and drying cycles WASH, RINSE, and DRY. When all of the cycles are completed, the light emitting portion "CLEAN" turns on and off for a predetermined time.

The user may set rinsing options RINSE OPTIONS through a course setting portion 930. The rinsing options include a sanitary rinsing SANITARY and an extra rinsing EXTRA RINSE for adding the rinsing cycle.

Other courses such as a power scrubbing course POWER SCRUB, a normal course NORMAL, a quick course QUICK, and a rinsing only course RINSE ONLY are illustrated in FIG. 16.

Referring to FIG. 16, in the power scrubbing course POWER SCRUB, the normal course NORMAL, and the quick course QUICK except for the rinsing only course RINSE ONLY the heated wash water is sprayed into the tub 712 during the washing cycle WASH or the rinsing cycle RINSE and a drying cycle DRY is performed. Accordingly, the inner temperature of the tub 712 increases during the courses. Therefore, the sterilizing effect can be expected. In the prior art where no sterilizing course exists, when the user operates the dishwasher that is left without being used for a long time, the power scrubbing course, the normal course, or the quick course has been frequently performed for the sterilization of the dishwasher before performing the washing. However, in order to complete each course, at least 78 minutes and at least 10 L of water are required. In addition, the temperature of the wash water sprayed in the washing cycle or the rinsing cycle increases only to 68° C. and thus it is not sufficient to kill the pathogenic bacteria and microorganisms. In addition, the operation time, energy consumption, and use of the water increase.

Accordingly, the dishwasher 700 according to the exemplary embodiment of the present invention provides the sterilizing course for satirizing the dishwasher. The sterilizing course may be selected through the input unit 735 of the control panel. A sterilizing course selecting portion 240 of FIG. 14 is an input unit for inputting the sterilizing course STERILIZATION.

When the sterilizing course is selected and input through the sterilizing course selecting portion 240, the controller 729 controls such that the sterilizing course is performed according to a preset algorithm. The sub cycles forming the sterilizing course will be described with reference to FIG. 15.

Referring to FIG. 15, the sterilizing course provided by the dishwasher according to the exemplary embodiment of the present invention includes a steam supply cycle 310, a washing cycle 320, and a drying cycle 330.

In the steam supply cycle 310, the steam is supplied into the tub 712 through the steam nozzle 727 and the filter mounting portion 723. That is, the wash water is first supplied into the sump 800 by controlling the water supply unit 733 and the wash water is heated by the heater 722 to generate the steam. At this point, a part of the steam is sprayed into the tub 712 through the steam nozzle 727 and another part of the steam is supplied into the tub 712 through the filter mounting portion 823 formed on the sump 800.

Since the steam is supplied into the tub for the steam supply cycle 310, the temperature of the inner surface of the tub 712 gradually increases. At this point, the inner surface of the tub should maintain a high temperature capable of killing the pathogenic bacteria and microorganisms for a predetermined time. The reference character Temp0 in FIG. 15 indicates an initial temperature of the inside of the tub 712, which is similar to a room temperature.

The table of FIG. 17 illustrates heating sterilizing conditions in accordance with types of the pathogenic bacteria and microorganisms. Most of the pathogenic bacteria except for the bacteria of anthrax are stamped out within a predetermined time at a temperature of 60° C. However, since the tubercle bacilli, *Pseudomonas* bacteria, and enterococcus are alive for at least 10 minutes at a temperature of 60° C., there is a need to increase the heating temperature above 60° C. to reduce the time taken for killing these bacteria. Particularly, in order to kill 0157 colon bacilli, the heating temperature should be above 75° C. and keeps this temperature for more than 1 minute. Accordingly, in the steam supply cycle 310, the temperature of the inner surface of the tub 712, may be above 75° C. and kept for more than 1 minute. In this case, most of the pathogenic bacteria propagated in the tub 712 are killed.

The operation of the heater 722 in the steam supply cycle 310 may be controlled based on a detecting value of the temperature sensor 732 or based on a temperature variation of the inner surface of the tube 712 in accordance with the operation time of the heater.

After the steam supply cycle 310, the washing process 320 may be further performed. In the washing cycle 320, the pump 850 operates and the wash water is sprayed into the tub 712 through at least one of the spray nozzles 713, 714, and 715.

In addition, after the washing cycle 320, the drying cycle 330 is further performed. In the drying cycle 330, the drain pump 725 operates to drain the wash water out of the sump 800, after which the heater 722 operates to dry the inside of the tub 712.

The purpose of the sterilizing course is not to wash the tableware but the dishwasher. Therefore, the steam supply cycle, washing cycle, drying cycle that constitute the sterilizing course may have a more simple operational algorithm than the courses for washing the tableware, such as the scrubbing course and the normal course. The time taken for each cycle is relatively very short.

Particularly, the temperature of the inner surface of the tub 712 should be increased to a predetermined level to satisfy the killing conditions of the pathogenic bacteria. It can be noted that, when the temperature of the tub keeps above 75° C. for more than 1 minute, most of the pathogenic bacteria are killed. According to the tests, 20-30 minutes after the steam supply cycle was sufficient to kill the most of the pathogenic bacteria. Particularly, since the time taken for performing the washing cycle and drying cycle performed after the steam supply cycle is shorter than that of the steam supply cycle, all cycles for the sterilizing course can be completed within 60 minutes.

According to this exemplary embodiment, when the user intends to use the dishwasher that has not been used for a long time, the dishwasher can be sterilized by the user selecting the sterilizing course, thereby improving the sanitation.

Further, the sterilizing effect for the filter mounting portion that is generally easily polluted can be improved.

In addition, since a special sterilizing course for sterilizing the dishwasher is provided, the time and energy consumption for sterilization can be reduced as compared with the prior art in which the washing course is performed to sterilize the dishwasher.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a tub having a receiving space, in which objects to be washed are received;

a sump that stores wash water supplied into the tub;

a heater that heats the wash water in the sump to generate steam;

a steam nozzle that sprays the steam into the tub;

a filter that filters the wash water supplied to the sump and communicates with the tub so that the steam generated in the sump is supplied into the tub; and a barrier that divides an inner space of the sump into a first section that communicates with the filter and a second section that communicates with the steam nozzle, wherein the barrier allows the wash water to flow between the first and second sections and suppresses a flow of the steam from the second section to the first section, wherein the sump includes a sump housing that receives the wash water, wherein the sump housing includes an inner bottom surface and an inner surface disposed at an upper side of the inner bottom surface, wherein the inner top surface prevents the steam from flowing in an upward direction, wherein the wash water is received between the inner bottom surface and the inner top surface, wherein the barrier extends from the inner top surface of the sump housing in a downward direction, and wherein a predetermined space is defined between the inner bottom surface of the sump housing and a lower end of the barrier.

2. The dishwasher of claim 1, further including a pump that directs the wash water from the sump housing to the tub.

3. The dishwasher of claim 2, wherein the pump is disposed at an upper side of the sump housing.

4. The dishwasher of claim 3, wherein the sump housing includes an opening in a top surface of the sump housing that communicates with the pump, and wherein the barrier is formed around the opening.

5. The dishwasher of claim 1, wherein the heater is operated while the sump is filled with the wash water above a water level at which the lower end of the barrier is submerged in the wash water.

6. The dishwasher of claim 1, wherein the steam in the first section is supplied into the tub through a first passage that communicates with the tub via the filter, and wherein the steam in the second section is supplied into the tub through a second passage that communicates with the tub via the steam nozzle.

7. The dishwasher of claim 6, wherein the second passage has a greater flow resistance than a flow resistance of the first passage.

8. The dishwasher of claim 6, further including a passage control member rotatably provided in the second passage, wherein the passage control member rotates from a closed position, in which position the passage control member closes the second passage, by a predetermined opening angle by pressure created by the steam supplied from the sump to open the second passage, and wherein a rotational shaft for rotational motion of the passage control member is movable within a predetermined range.

9. The dishwasher of claim 8, wherein the predetermined opening angle is set within a range within which the passage control member, when the supply of the steam from the sump stops, returns to the closed position by self-gravity of the passage control member.

10. The dishwasher of claim 9, wherein the predetermined opening angle is less than 90 degree.

11. The dishwasher of claim 8, wherein the rotation of the passage control member is limited up to the predetermined opening angle as the passage control member contacts an inner surface of the second passage when the passage control member rotates to open the second passage, wherein at least one of the passage control member or the second passage includes a protrusion, and wherein the contact between the passage control member and the second passage is realized by the protrusion in a state in which the passage control member rotates up to the predetermined opening angle.

12. The dishwasher of claim 8, further including a rotational shaft supporting portion formed in the second passage to support the rotational shaft of the passage control ember, wherein the rotational shaft supporting portion includes a hole or a groove that supports the rotational shaft of the passage control member and allows the rotational shaft to move within a predetermined distance.

13. The dishwasher of claim 8, further including a water exhaust hole through which water formed by condensation of the steam in a space between the passage control member and the nozzle is exhausted out of the second passage in a state in which the second passage is closed by the passage control member, wherein the water exhausting hole communicates an outer side of the second passage with an inner side of the second passage.

14. The dishwasher of claim 13, wherein the water exhaust hole communicates the inner sick of the second passage with an inner side of the tub.

15. The dishwasher of claim 13, wherein the water exhaust hole is disposed at a location higher than a water supply allowable level for the wash water supplied into the tub for washing.

16. The dishwasher of claim 8, wherein the passage control member is formed of a flexible material.

17. The dishwasher of claim 6, further including a passage controller that controls the second passage, wherein the second passage includes a steam supply passage through which the steam generated in the sump is supplied to the steam nozzle, wherein the passage controller includes:

a passage control member which is rotated by a pressure created by the steam supplied through the steam supply passage to open the steam supply passage by rotating a predetermined opening angle from a position in which the steam supply passage is closed; and a passage controller housing that defines a space in which the passage control member operates, and wherein the passage controller housing includes a rotational shaft supporting portion that supports a rotational shaft of the passage control member and allows the rotational shaft to move within a predetermined distance.

18. The dishwasher of claim 17, wherein the passage controller housing connects the steam supply passage to the steam nozzle.

19. The dishwasher of claim 18, wherein the passage controller housing further includes a limit surface that limits the rotation of the passage control member to the predetermined opening angle when the passage control member operates to open the steam supply passage, and wherein the limit surface is inclined with respect to a horizontal plan.

20. The dishwasher of claim 4, wherein the opening is disposed in the first section.

* * * * *